US009815273B2

(12) United States Patent
Hirabayashi

(10) Patent No.: US 9,815,273 B2
(45) Date of Patent: Nov. 14, 2017

(54) RECORDING HEAD, METHOD FOR PRODUCING SAME, AND RECORDING DEVICE

(71) Applicant: FUJIFILM Corporation, Tokyo (JP)

(72) Inventor: Yasutoshi Hirabayashi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/048,441

(22) Filed: Feb. 19, 2016

(65) Prior Publication Data

US 2016/0167365 A1 Jun. 16, 2016

Related U.S. Application Data

(63) Continuation of application No. PCT/JP2014/068578, filed on Jul. 11, 2014.

(30) Foreign Application Priority Data

Sep. 4, 2013 (JP) ..... 2013-182901

(51) Int. Cl.
*B41J 2/21* (2006.01)
*B41J 2/045* (2006.01)
*B41J 2/145* (2006.01)

(52) U.S. Cl.
CPC ..... *B41J 2/04508* (2013.01); *B41J 2/04586* (2013.01); *B41J 2/145* (2013.01); *B41J 2/2146* (2013.01); *B41J 2202/20* (2013.01); *B41J 2202/21* (2013.01)

(58) Field of Classification Search
CPC .. B41J 2/04508; B41J 2/04586; B41J 2/2146; B41J 2202/21; B41J 2202/20
See application file for complete search history.

(56) References Cited

FOREIGN PATENT DOCUMENTS

| | | | | |
|---|---|---|---|---|
| EP | 0914950 | A2 * | 5/1999 | ..... B41J 2/155 |
| JP | H11-198380 | A | 7/1999 | |
| JP | 2002-029042 | A | 1/2002 | |
| JP | 2006-346575 | A | 12/2006 | |
| JP | 2007-022092 | A | 2/2007 | |
| JP | 2007-160834 | A | 6/2007 | |

OTHER PUBLICATIONS

International Search Report of PCT/JP2014/068578 dated Oct. 14, 2014.
Written Opinion of PCT/JP2014/068578 dated Oct. 14, 2014.

* cited by examiner

*Primary Examiner* — Sharon A Polk
(74) *Attorney, Agent, or Firm* — Studebaker & Brackett PC

(57) ABSTRACT

Provided are a recording head capable of suppressing concentration unevenness at a connection portion of head modules, a method for producing the recording head, and a recording device having the recording head. A recording head of a recording device is configured such that a first head module in which an ejection amount of the liquid droplets of one end portion in the one direction of a head module, in which a plurality of nozzles for ejecting liquid droplets are arranged, is larger than an ejection amount of the liquid droplets of the other end portion opposite to the one end portion, and a second head module in which the ejection amount of the liquid droplets of the other end portion is larger than the ejection amount of the liquid droplets of the one end portion are alternately connected in the one direction.

10 Claims, 20 Drawing Sheets

FIG. 21

| HEAD MODULE No. J | HEAD MODULE No. J + 1 |
|---|---|
| 9A L1 | 9A L1<br>9B R1<br>9B R2 |
| 9A L2 | 9B R1<br>9B R2<br>9B R3 |
| 9A L3 | 9B R2<br>9B R3 |
| 9B R1 | 9B R1<br>9A L1<br>9A L2 |
| 9B R2 | 9A L1<br>9A L2<br>9A L3 |
| 9B R3 | 9A L2<br>9A L3 |

RECORDING HEAD, METHOD FOR PRODUCING SAME, AND RECORDING DEVICE

CROSS-REFERENCE TO RELATED APPLICATIONS

This application is a Continuation of PCT International Application No. PCT/JP2014/068578 filed on Jul. 11, 2014, which claims priority under 35 U.S.C §119(a) to Japanese Patent Application No. 2013-182901 filed on Sep. 4, 2013. Each of the above application(s) is hereby expressly incorporated by reference, in its entirety, into the present application.

BACKGROUND OF THE INVENTION

1. Field of the Invention

The present invention relates to a recording head which is configured such that a plurality of head modules are connected in one direction, a method for producing the recording head, and a recording device having the recording head.

2. Description of the Related Art

An ink jet printer (recording device) is known, in which ink is ejected from a plurality of nozzles provided in an ink jet head (recording head) so as to form an image on a recording medium. As a recording method of the ink jet printer, a line type printer is known in which an image is recorded by transport of a recording medium and a single drawing pass performed by the ink jet head. In the line type printer, as the ink jet head, a long line head is used, which is configured such that a plurality of head modules having nozzles two-dimensionally arranged are connected in a width direction (main scanning direction) of the recording medium.

In this ink jet printer, concentration unevenness may occur on a recording image due to variation in ejection characteristics (for example, variation in an ejection amount of ink or a landing position of ink) of each nozzle of the ink jet head. Accordingly, in the ink jet printer, in general, in order to solve the concentration unevenness, the occurrence of the concentration unevenness is suppressed by correcting image data based on a concentration unevenness correction table or by correcting image data based on a gradation correction table for each predetermined unit. However, when the ink jet head is the line head, an ejection amount (droplet amount) of ink in a connection portion between head modules adjacent to each other is not continuous. In addition, when a difference of ejection amounts in the connection portion is large, it is not possible to completely correct the concentration unevenness.

JP2007-22092A discloses an ink jet printer in which when characteristics of concentration changes of images recorded by an ink jet head are shown by line graphs, image data in which the line graphs draw lines having gradients is generated, and image recording is performed based on the image data. According to the ink jet printer of JP2007-22092A, since a level difference of concentration in the connection portion of the head modules is suppressed, the occurrence of the concentration unevenness is relatively prevented.

JP2007-160834A discloses an ink jet printer, in which head modules are disposed in order of average ejection amounts or average ejection amounts of a first head module and an Nth head module are made to be the same as each other such that differences of the average ejection amounts between the first head module and the Nth head module are approximately constant. According to the ink jet printer of JP2007-160834A, since the lines of the head modules are regulated such that the level differences of the average ejection amounts decrease, the level differences of concentrations in the connection portion of the head modules are relatively suppressed, and as a result, the occurrence of the concentration unevenness is prevented.

SUMMARY OF THE INVENTION

However, in the ink jet printer of JP2007-22092A, when the difference of the original ejection amounts in the connection portion of the head modules is large, since it is not possible to correct the image data, the concentration unevenness occurs. In addition, in a correction method of the concentration unevenness according to the ink jet printer of JP2007-22092A, viewable concentration unevenness is relatively suppressed. However, since the concentration difference of the entire image is large, an image having a large gradation occurs.

In the ink jet printer of JP2007-160834A, even when the variation of the average ejection amount between the head modules is considered, the variation of the ejection amount in the individual head module is not considered. Accordingly, in the ink jet printer disclosed in JP2007-160834A, since the ejection amount of ink between end portions of the head modules adjacent to each other increases, the level difference of the concentration in the connection portion of the head module may increase. Therefore, in the ink jet printer disclosed in JP2007-160834A, it is not possible to suppress the level difference of the concentration in the connection portion of the head modules, and there is a concern that the concentration unevenness may occur.

In this way, in the ink jet printers of JP2007-22092A and JP2007-160834A, when both end portions of the head module have large differences of the ejection amounts, since the difference of the ejection amount in the connection portion of the head modules increases, there is a concern that the concentration unevenness may occur. Accordingly, it is not possible to use the head module having the large difference of the ejection amounts on both the end portions in the ink jet head.

An object of the present invention is to provide a recording head capable of suppressing concentration unevenness in a connection portion of head modules, a method for producing the recording head, and a recording device having the recording head.

In order to achieve the object of the present invention, there is provided a recording head including a plurality of head modules in which a plurality of nozzles for ejecting liquid droplets are arranged and which are connected in one direction, in which a first head module in which an ejection amount of the liquid droplets of one end portion in the one direction of the head module is larger than an ejection amount of the liquid droplets of the other end portion opposite to the one end portion, and a second head module in which the ejection amount of the liquid droplets of the other end portion is larger than the ejection amount of the liquid droplets of the one end portion are configured so as to be alternately connected in the one direction.

According to the present invention, it is possible to decrease a difference of the ejection amounts of the liquid droplets at a connection portion of the head modules. In addition, since a head module having the difference of the ejection amounts of ink on both end portions can be used, it is possible to increase yields of the head module.

Preferably, the first head module is exchangeable with the first head module for exchange, and the second head module is exchangeable with the second head module for exchange. After the head module (first head module and second head module) is exchanged, since it is possible to decrease the difference of the ejection amounts of the liquid droplets at the connection portion of the head module, it is possible to suppress the occurrence of concentration unevenness at the connection portion.

In order to achieve the object of the present invention, there is provided a recording head including a plurality of head modules in which a plurality of nozzles for ejecting liquid droplets are arranged and which are connected in one direction, in which the head modules are divided into 2n steps (n is a natural number of 2 or more) according to a difference of ejection amounts of liquid droplets in one end portion in the one direction and the other end portion opposite to the one end portion, the divisions of the 2n steps are configured of a first division in which the head modules in which an ejection amount of liquid droplets of the one end portion is larger than an ejection amount of liquid droplets of the other end portion are divided into n steps, and a second division in which the head modules in which the ejection amount of liquid droplets of the other end portion is larger than the ejection amount of liquid droplets of the one end portion are divided into n steps, and the head modules adjacent to each other are configured of the head modules in which the difference of the ejection amounts with respect to the head module of ith step ($1 \leq i \leq n$) in one of the first division and the second division and the head module of ith step of the other is within k (k is a natural number of (n−1) or less) steps.

According to the present invention, it is possible to decrease the difference of the ejection amounts of the liquid droplets at the connection portion of the head modules. In addition, since a head module having the difference of the ejection amounts of ink on both end portions can be used, it is possible to increase yields of the head module.

Preferably, a range of the difference of the ejection amounts corresponding to a range of each of the n steps is uniform. Accordingly, it is possible to decrease the difference of the ejection amounts of the liquid droplets at the connection portion of the head modules.

Preferably, the number of the head modules belonging to each of the n steps is uniform. Accordingly, it is possible to decrease the difference of the ejection amounts of the liquid droplets at the connection portion of the head modules.

Preferably, the n steps are 3 steps, and the k step is 1 step. Accordingly, it is possible to decrease the difference of the ejection amounts of the liquid droplets at the connection portion of the head modules. In addition, it is possible to decrease the kinds of the head modules required to be stocked for exchange.

Preferably, the head modules of the first division and the head modules of the second division are alternately connected in the one direction, and the head module which is divided into a second step among 3 steps is used for the head module for exchange. It is possible to decrease the kinds of the head modules required to be stocked for exchange.

In order to achieve the object of the present invention, there is provided a recording device which includes a recording head described in any one of claims, a relative movement unit which moves the recording head and a recording medium relative to each other in a vertical direction with respect to the one direction, and a recording control unit which controls the recording head and the relative movement unit and records an image on the recording medium by the recording head.

Preferably, the recording control unit includes a concentration measurement unit which records a test chart as the image on the recording medium by the recording head and measures a concentration of the test chart, an average ejection amount correction value calculation unit which calculates an average ejection amount of liquid droplets for each head module from measurement results of the concentration measurement unit, and calculates an average ejection amount correction value to uniformly correct the average ejection amount for each head module based on calculation results of the average ejection amount, and an average ejection amount correction unit which uniformly corrects the average ejection amount for each head module based on the average ejection amount correction value calculated by the average ejection amount correction value calculation unit. Accordingly, it is possible to decrease the difference of the ejection amounts of the liquid droplets at the connection portion of the head modules.

Preferably, the average ejection amount correction value calculation unit calculates a voltage correction value which corrects the voltage of driving signals, which control ejection from the nozzles for each head module, as the average ejection amount correction value, and the average ejection amount correction unit corrects the voltage of the driving signals of the nozzles for each head module based on the voltage correction value. Accordingly, it is possible to decrease the difference of the ejection amounts of the liquid droplets at the connection portion of the head modules.

Preferably, the recording device further includes: a concentration correction value calculation unit which calculates a concentration correction value to constantly correct the concentrations of the images recorded on the recording medium by the recording heads over all recording heads, based on the measurement results of the concentration measurement unit; and a concentration correction unit which corrects the concentrations of the images recorded on the recording medium by the recording heads, based on the concentration correction value calculated by the concentration correction value calculation unit. Accordingly, it is possible to suppress the concentration unevenness of images.

In order to achieve the object of the present invention, there is provided a method for producing a recording head including a plurality of head modules in which a plurality of nozzles for ejecting liquid droplets are arranged and which are connected in one direction, in which the head modules are divided into 2n steps (n is a natural number of 2 or more) according to a difference of ejection amounts of liquid droplets in one end portion in the one direction and the other end portion opposite to the one end portion, the divisions of the 2n steps are configured of a first division in which the head modules in which an ejection amount of liquid droplets of the one end portion is larger than an ejection amount of liquid droplets of the other end portion are divided into n steps, and a second division in which the head modules in which the ejection amount of liquid droplets of the other end portion is larger than the ejection amount of liquid droplets of the one end portion are divided into n steps, and the head modules adjacent to each other are configured of the head modules in which the difference of the ejection amounts with respect to the head module of ith step ($1 \leq i \leq n$) in one of the first division and the second division and the head module of ith step of the other is within k (k is a natural number of (n−1) or less) steps.

According to the recording head, the method for producing the recording head, and the recording device of the present invention, it is possible to suppress the concentration unevenness at the connection portion of the head modules.

BRIEF DESCRIPTION OF THE DRAWINGS

FIG. 21 is an explanatory diagram for explaining a relationship between the head modules adjacent to each other when n=3 and k=1 are satisfied.

DESCRIPTION OF THE PREFERRED EMBODIMENTS

[Overall Configuration of Ink Jet Printer of First Embodiment]

Figure 1:
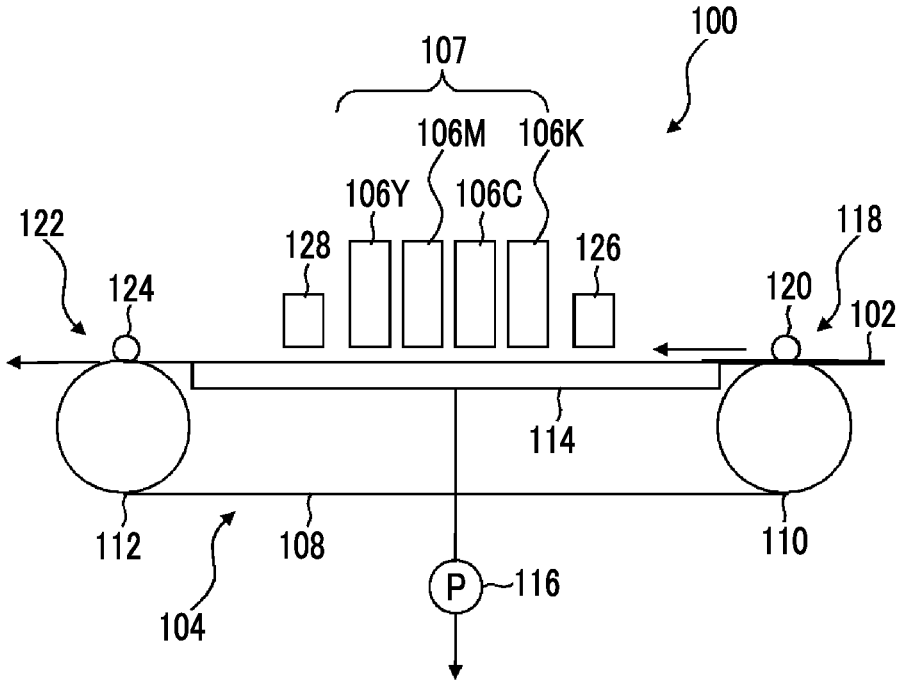
FIG. 1 is a schematic diagram showing an ink jet printer of a first embodiment.

As shown in FIG. 1, an ink jet printer (recording device) 100 is configured so as to include a recording medium transportation unit (relative movement unit) 104 which holds and transports a recording medium 102, and a printing unit 107. The printing unit 107 includes ink jet heads (recording heads) 106K, 106C, 106M, and 106Y which eject color ink corresponding to K (black), C (Cyan), M (Magenta), and Y (Yellow) with respect to the recording medium 102 which is held by the recording medium transportation unit 104.

The recording medium transportation unit 104 includes an endless transportation belt 108 in which a plurality of adsorption holes (not shown) are provided in a recording medium holding region in which the recording medium 102 is held, transportation rollers (driving roller and driven roller) 110 and 112 around which the transportation belt 108 is wound, a chamber 114 which is provided on a rear surface (a surface opposite to the recording medium holding surface to which the recording medium 102 is held) of the transportation belt 108 of the recording medium holding region and generates a negative pressure in adsorption holes (not shown) provided in the recording medium holding region, and a vacuum pump 116 which generates a negative pressure in the chamber 114.

A pressure roller 120 for preventing the recording medium 102 from floating is provided on a feeding unit 118 by which the recording medium 102 is fed. In addition, a pressure roller 124 is provided on a discharging unit 122 by which the recording medium 102 is discharged.

A negative pressure is applied to the recording medium 102, which is fed from the feeding unit 118, from adsorption holes which are provided in the recording medium holding region, and the recording medium 102 is held in the recording medium holding region of the transportation belt 108.

A temperature adjustment unit 126 for adjusting a surface temperature of the recording medium 102 to a predetermined range is provided on a front step side (upstream side in a recording medium transport direction) of the printing unit 107 on a transport path of the recording medium 102. In addition, a scanner (concentration measurement unit) 128 which reads an image or test charts 20 and 21 (refer to FIG. 4) recorded on the recording medium 102 is provided on a rear step side (downstream side in the recording medium transport direction) of the printing unit 107.

The recording medium 102 fed from the feeding unit 118 is adsorbed and held in the recording medium holding region of the transportation belt 108 and is subjected to temperature adjustment processing by the temperature adjustment unit 126, and thereafter, the image recording is performed on the recording medium 102 by the printing unit 107.

After the image of the recording medium 102 is recorded, the recording image (test charts 20 and 21, or the like) is read by the scanner 128, and thereafter, the recording medium 102 is discharged from the discharging unit 122.

<Configuration of Ink Jet Head>

The ink jet heads 106K, 106C, 106M, and 106Y included in the printing unit 107 are full line type line heads in which a plurality of nozzles are disposed over a length exceeding the entire width of the recording medium 102. Hereinafter, the ink jet heads 106K, 106C, 106M, and 106Y are simply referred to as an "ink jet head 106".

Figure 2:
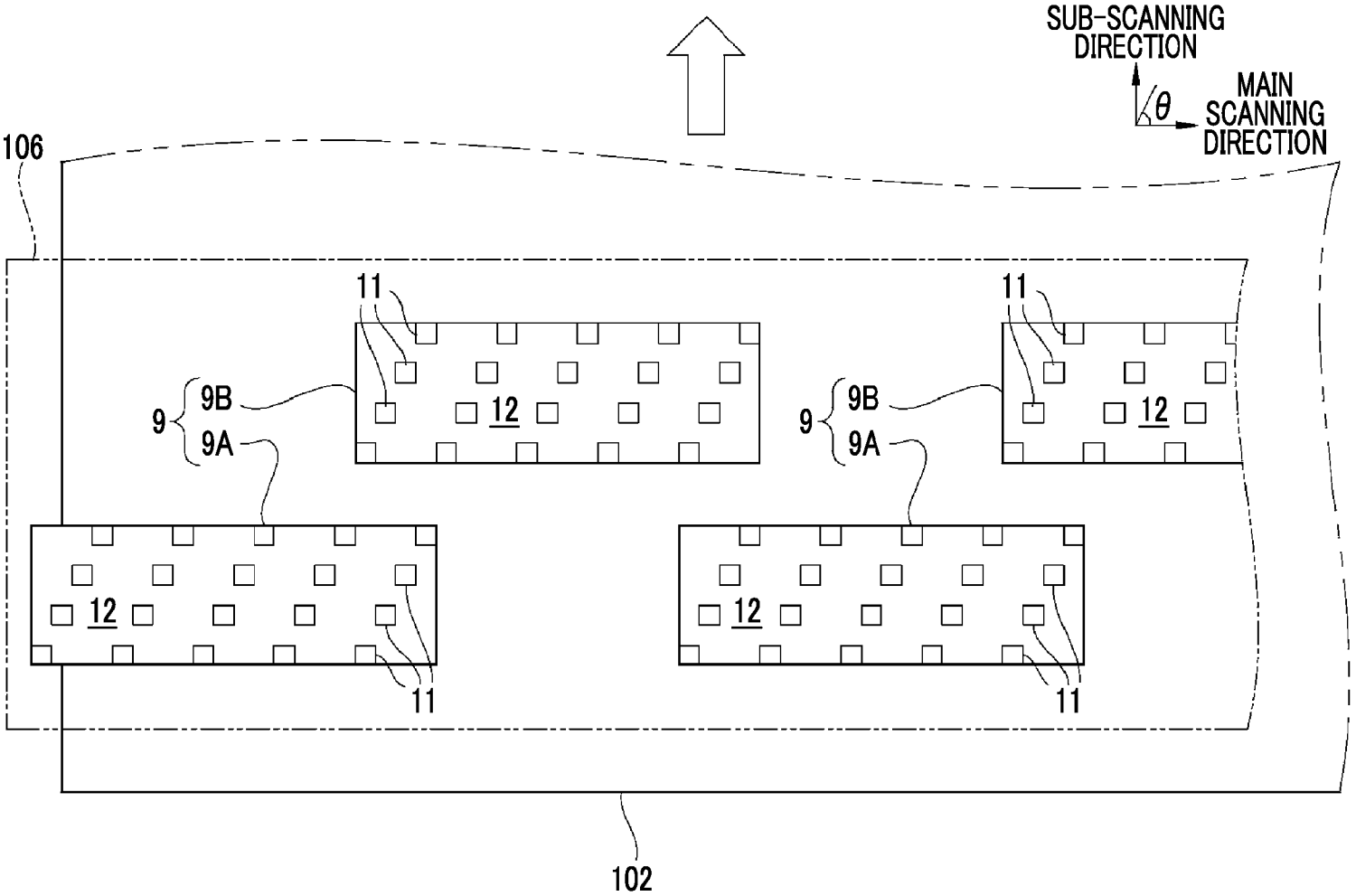
FIG. 2 is a schematic diagram of an ink jet head of the first embodiment.

As shown in FIG. 2, the ink jet head 106 has a structure in which a plurality of head modules 9 are connected to each other in a main scanning direction (one direction) orthogonal to a sub-scanning direction (vertical direction) which is a transport direction of the recording medium 102. Specifically, the head modules 9 are disposed in a zigzag along the main scanning direction. In addition, end portions of the head modules 9 adjacent to each other overlap in the main scanning direction.

Each head module 9 has a nozzle surface 12 on which nozzles 11 from which ink (liquid droplets) is ejected are arranged, and is mounted so as to be exchanged with a main body of the ink jet head 106. In addition, FIG. 2 is a top diagram of the ink jet head 106, and shows the ink jet head 106 in a state where nozzles 11 arranged on the lower surface or the nozzle surface 12 thereof are transmitted. In the nozzle surface 12, a nozzle row is formed in which the plurality of nozzles 11 are arranged along an inclination direction having a predetermined angle θ with respect to the main scanning direction, and the plurality of nozzle rows are arranged in the main scanning direction.

Each head module 9 is configured so as to include a first head module 9A and a second head module 9B. In the first head module 9A, an ejection amount of ink of one end portion in the main scanning direction (hereinafter, referred to as one end direction) is larger than an ejection amount of ink of the other end portion in the main scanning direction (hereinafter, referred to as the other end). On the other hand, in the second head module 9B, the ejection amount of ink of the other end portion is larger than the ejection amount of ink of the one end portion. That is, in the first and second head modules 9A and 9B, inclination directions (refer to FIG. 3) in the ejection amount distribution of ink are different from each other. Moreover, here, each of the ejection amounts of ink of the one end portion of the other end portion means an average value of the ink ejection amounts of a region (may include a region within a predetermined range from the connection portion) which is used in the connection portion between the head modules 9. In addition, a measurement of the ejection amount of ink is performed by a method of obtaining the ejection amount from a dot diameter of ink, a line width, a recording concentration, or the like.

Figure 3:
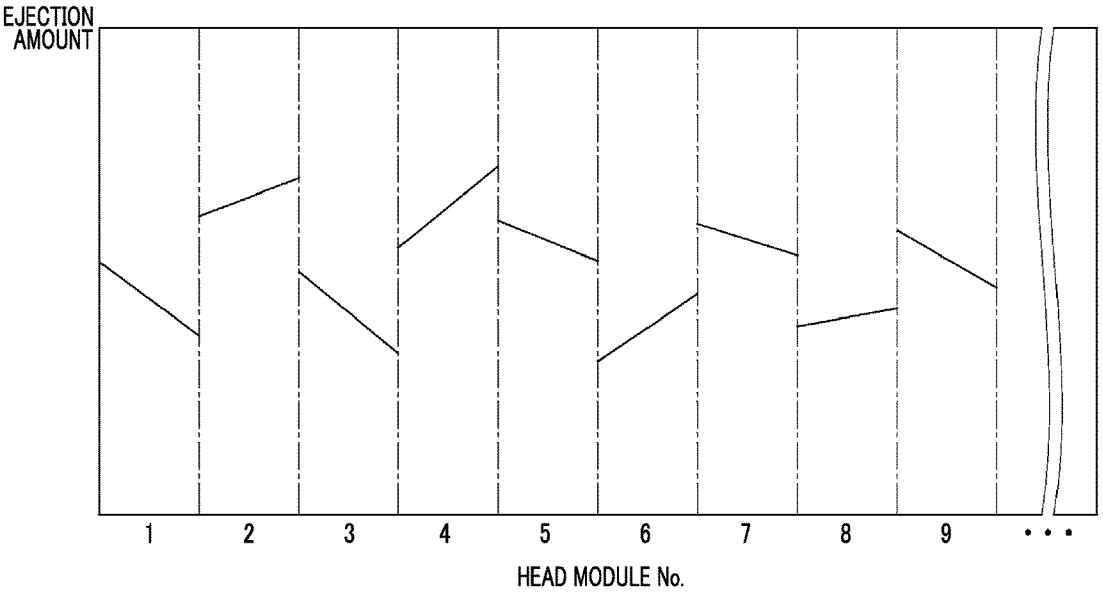
FIG. 3 is an explanatory diagram for explaining an ejection amount distribution of ink of each head module configuring the ink jet head.

The first and second head modules 9A and 9B are alternately connected to each other in the main scanning direction. Accordingly, as shown in FIG. 3, the one end portion of the first head module 9A having a large ejection amount and the other end portion of the second head module 9B having a large ejection amount are disposed so as to be adjacent to each other. In addition, the other end portion of the first head module 9A having a small ejection amount and the one end portion of the second head module 9B having a small ejection amount are disposed so as to be adjacent to each other. Moreover, in the present embodiment, the ejection amount of ink of each of the first and second head modules 9A and 9B is linearly changed between the one end portion and the other end portion. However, the ejection amount may be changed in a curve such as a quadratic curve.

<Configuration of Control System>

Figure 4:
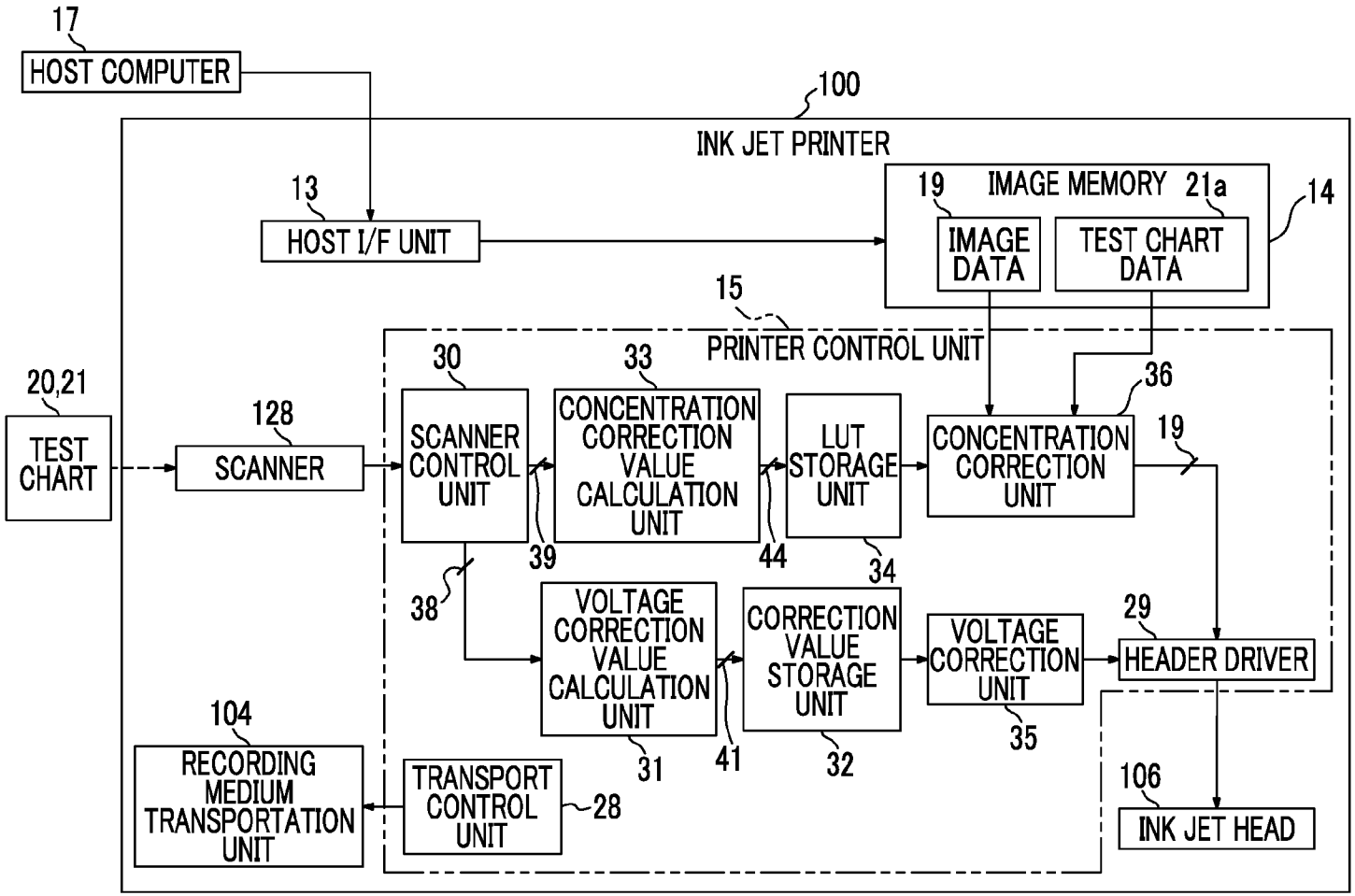
FIG. 4 is a block diagram showing an electric configuration of the ink jet printer.

As shown in FIG. 4, in the ink jet printer 100, in addition to the recording medium transportation unit 104, the ink head 106, the scanner 128, or the like, a host I/F unit 13, an image memory 14, a printer control unit (recording control unit) 15, or the like is provided.

The host I/F unit 13 is a so-called communication interface which receives image data sent from a host computer 17. The host I/F unit 13 sends the image data, which is received from the host computer 17, to the image memory 14.

The image memory 14 stores image data 19 which is input via the host I/F unit 13. For example, as the image memory 14, a DRAM having a storage capacity capable of storing image data 19 of one page, or the like is used. In addition, in the image memory 14, test chart data 21*a*, which is image data of the test chart 21 for correcting the concentration unevenness, is stored.

The test chart 20 is used so as to calculate a voltage correction value 41 by a voltage correction value calculation unit 31 described below. The test chart 20 has a pattern which is formed by hitting (ejecting) the ink of the same kind by the same hitting number using each nozzle 11. For example, in the present embodiment, under the control of the printer control unit 15, the test chart 20 is formed by hitting ink having intermediate-size droplets at a recording concentration of 25% using each nozzle 11.

Figure 5:
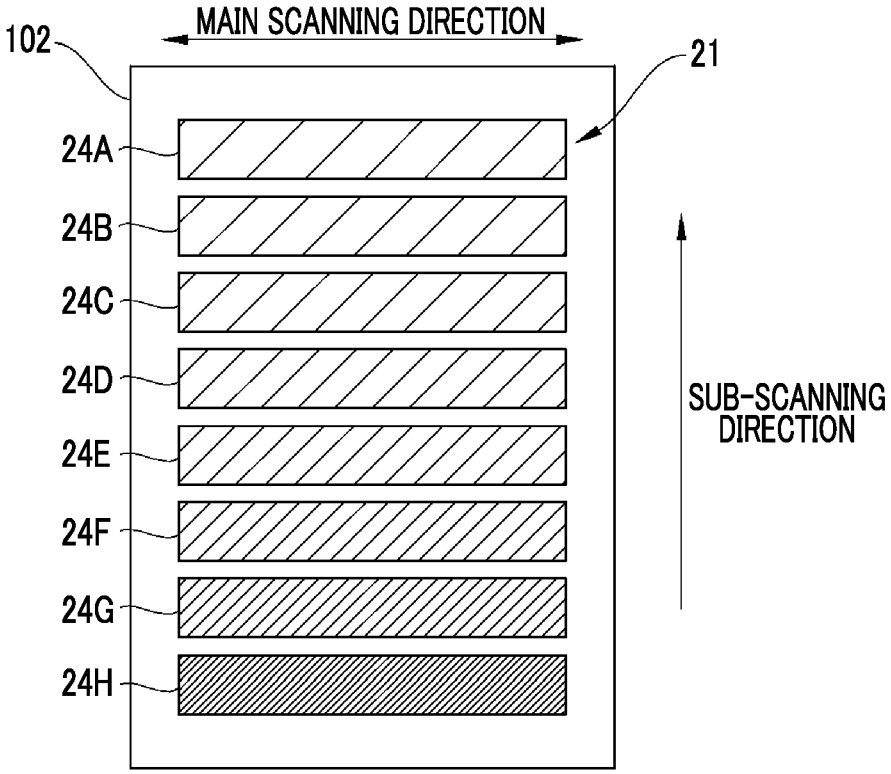
FIG. 5 is a schematic diagram of a test chart for correcting concentration unevenness.

As shown in FIG. 5, the test chart 21 for correcting the concentration unevenness is configured so as to include a plurality of kinds of band-shaped patterns 24A to 24H which are prepared according to each color of CMYK and have different gradation values (that is, concentrations). Each of the patterns 24A to 24H has a rectangular shape which is long along the main scanning direction. In addition, each of the patterns 24A to 24H is formed so as to have an approximately uniform concentration within a range corresponding to the length of the ink jet head 106 in the main scanning direction. The "approximately uniform concentration" means that a command value (set value) of gradation is constant when the pattern is recorded. By measuring a concentration distribution of the pattern which is drawn based on the command of the constant gradation value, it is possible to understand variation of ejection characteristics of each nozzle 11 corresponding to the gradation value. In addition, an arrangement order of the patterns or the number of the band-shaped patterns (the number of steps which change the gradation value) may be appropriately changed.

The printer control unit 15 includes a transport control unit 28, a head driver 29, a scanner control unit 30, a voltage correction value calculation unit (average ejection amount correction value calculation unit) 31, a correction value storage unit 32, a concentration correction value calculation unit 33, an LUT storage unit 34, a voltage correction unit (average ejection amount correction unit) 35, and a concentration correction unit 36. The printer control unit 15 integrally controls the overall operation of the ink jet printer 100 by controlling each of the units.

The transport control unit 28 controls the transport of the recording medium 102 by controlling rotation/stopping, and rotating speeds of the transportation rollers 110 and 112 of the recording medium transportation unit 104. Accordingly, it is possible to relatively move the recording medium 102 with respect to the ink jet head 106.

Image signals of the image data 19, which is concentration-processed by the concentration correction unit 36 described below and is half-tone processed by a half-tone processing unit (not shown), are input to the head driver 29. In addition, for example, the half-tone processing unit converts image signals of each color having a multi-level gradation of the image data 19 into signals of four values such as "ink having large-size droplets being ejected", "ink having intermediate-size droplets being ejected", "ink having small-size droplets being ejected", and "ejection not being performed".

The head driver 29 outputs driving signals corresponding to each nozzle 11 (hereinafter, simply referred to as driving signals) to each nozzle 11 based on the half-tone processed image signals of the four values, and controls the ink ejection from each nozzle 11. A large-size dot, an intermediate-size dot, and a small-size dot are recorded on a recording surface of the recording medium 102 by the ink having large-size droplets, the ink having intermediate-size droplets, and the ink having small-size droplets. By hitting ink droplets of each color of CMYK against the recording medium 102 using the ink jet head 106 while transporting the recording medium 102 by the recording medium transportation unit 104, recording images based on the image data 19 are formed on the recording surface of the recording medium 102.

The scanner control unit 30 controls reading and concentration measurement of the test charts 20 and 21 by the scanner 128. The scanner control unit 30 performs the concentration measurement by the scanner 128 in accordance with timing when the test charts 20 and 21 pass through the scanner 128 after the test charts 20 and 21 are recorded on the recording medium 102. In addition, it is possible to perform tracking on the positions of the test charts 20 and 21 based on known transport speed information of the recording medium 102.

When the concentration measurement of the test chart 20 is performed by the scanner 128, the scanner control unit 30 acquires the concentration measurement results 38 of the test chart 20 from the scanner 128. As described above, the test chart 20 is formed by hitting the ink having the same kind of droplets by the same number of hitting using each nozzle 11. Accordingly, the concentration measurement results 38 include the concentration measurement value of each position in the main scanning direction of each head module 9 (first and second head modules 9A and 9B) which is not subjected to the concentration correction processing or the half-tone processing. In addition, the scanner control unit 30 outputs the concentration measurement results 38 to the voltage correction value calculation unit 31.

Moreover, when the concentration measurement of the test chart 21 is performed by the scanner 128, the scanner control unit 30 acquires the concentration measurement results 39 of each of the patterns 24A to 24H of the test chart 21 from the scanner 128. The concentration measurement results 39 include the concentration measurement value at each position of the patterns 24A to 24H in the main scanning direction. Accordingly, the concentration value of each position of the head module 9 (first and second head modules 9A and 9B) in the main scanning direction is obtained. In addition, the scanner control unit 30 outputs the concentration measurement results 39 to the concentration correction value calculation unit 33.

The voltage correction value calculation unit 31 determines the concentration measurement value of each position of the ink jet head 106 in the main scanning direction based on the concentration measurement results 38 input from the scanner control unit 30. Moreover, the voltage correction value calculation unit 31 obtains an average value of the concentration measurement value for each head module 9 based on the concentration measurement value of each position of the ink jet head 106 in the main scanning direction.

Figure 6:
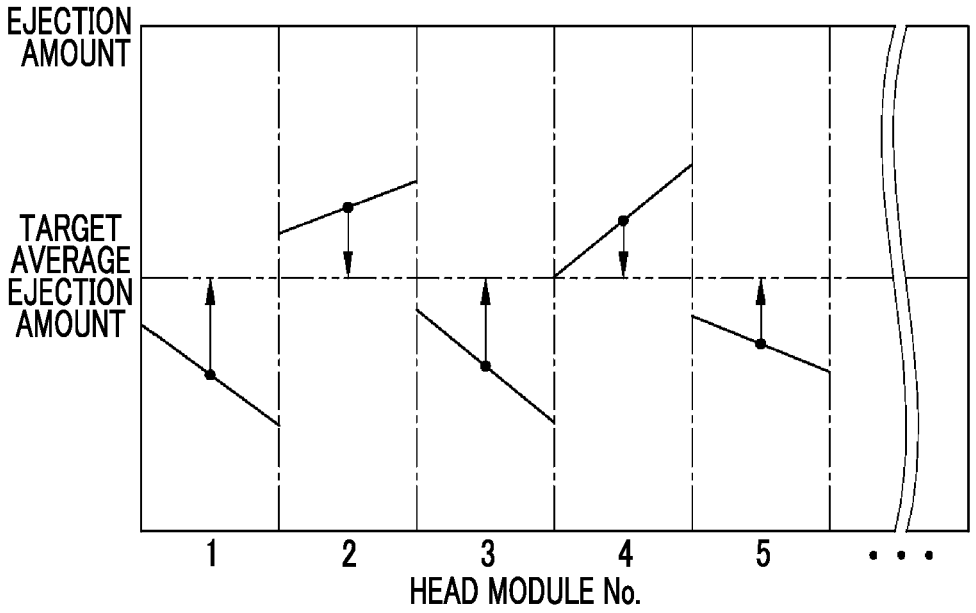
FIG. 6 is an explanatory diagram for explaining voltage correction of driving signals output from each head module.

In FIG. 6, the voltage correction value calculation unit 31 calculates an average ejection amount (indicated by a black point in FIG. 6) of ink for each head module 9 from the average value of the concentration measurement values for each head module 9. Specifically, since there is a constant relationship between the concentration measurement value and the ink ejection amount, by obtaining a correlation between the ink ejection amount (droplet amount) and the concentration in advance, and based on this correlation, it is possible to calculate an actual average ejection amount of ink from the average value of the concentration measurement values for each head module 9.

Sequentially, the voltage correction value calculation unit 31 calculates the voltage correction value 41 (refer to FIG. 4) to correct the voltages of the above-described driving signals corresponding to the nozzles 11 for each head module 9 such that the average ejection amount of ink for each head module 9 is the same as a target average ejection amount. In addition, for example, the target average ejection amount is an average value of the average ejection amounts for each head module 9. The voltage correction value calculation unit 31 stores the voltage correction value 41 for each head module 9 in the correction value storage unit 32 (refer to FIG. 4).

Figure 7:
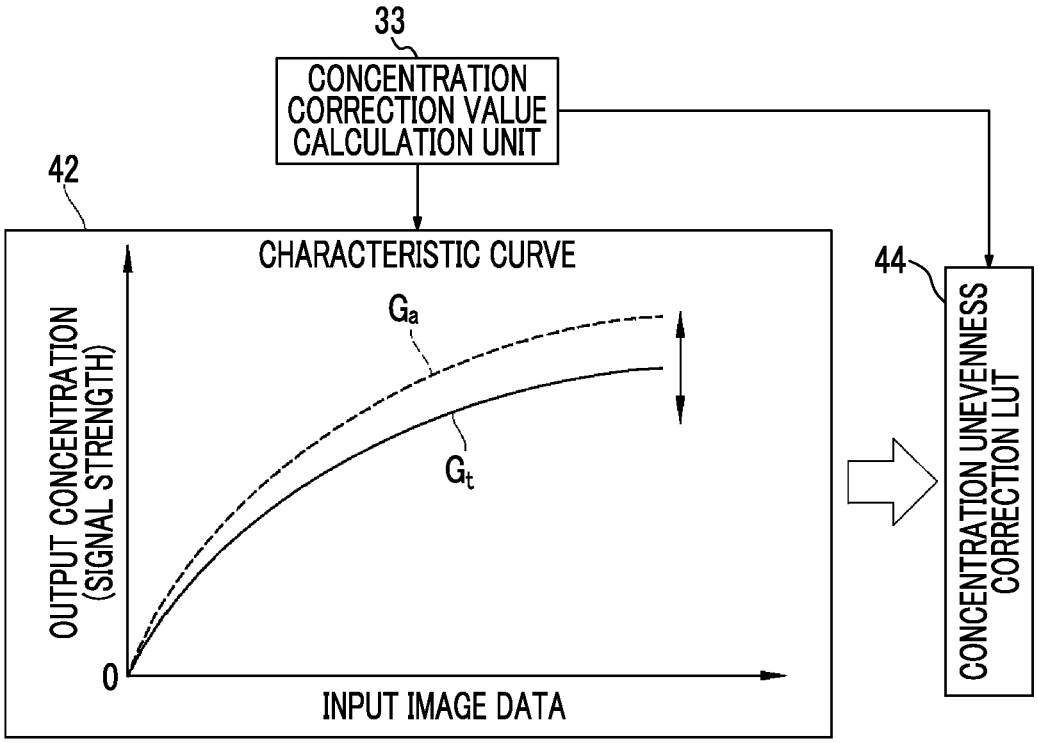
FIG. 7 is an explanatory diagram for explaining calculation processing of LUT for correcting the concentration unevenness.

As shown in FIG. 7, the concentration correction value calculation unit 33 acquires output concentration data indicating the output recording concentration (ink concentration) for each nozzle 11, based on the concentration measurement results 39 input from the scanner control unit 30. In addition, the concentration correction value calculation unit 33 obtains a characteristic curve 42 indicating ejection characteristics for each nozzle 11, based on the output concentration data and an input gradation value for each of the patterns 24A to 24H.

The characteristic curve 42 in FIG. 7 shows an example of characteristic curves, a lateral axis indicates the input image data (input gradation value), and a vertical axis indicates the output concentration. A curve Gt in FIG. 7 indicates the characteristic curve of the nozzle 11 which is obtained from the concentration measurement results 39. A curve Ga shown by a broken line in FIG. 7 indicates a characteristic curve (appropriate characteristic curve) which is obtained when appropriate ink ejection assumed on design is performed. As shown in FIG. 7, in general, the solid-line actual characteristic curve Gt of the nozzle 11 is drawn so as to be slightly deviated from the appropriate characteristic curve due to variation of manufacturing or other reasons, and variation of the output concentration values between the nozzles 11 occurs as shown by an arrow having both upper and lower directions in FIG. 7. The concentration correction value calculation unit 33 compares the characteristic curve Gt and the appropriate characteristic curve Ga of each nozzle 11, and generates a concentration unevenness correction LUT 44 indicating a table of the correction values with respect to the ejection control of the target nozzle 11, based on the comparison results. In addition, the concentration correction value calculation unit 33 stores the concentration unevenness correction LUT 44 in the LUT storage unit 34 (refer to FIG. 4).

Returning to FIG. 4, the voltage correction unit 35 corrects the voltages of the driving signals, which are output from the head driver 29 to each nozzle 11, for each head module 9, based on the voltage correction value 41 read out from the correction value storage unit 32. Accordingly, as shown in FIG. 6, the average ejection amount of the ink for each head module 9 is the same as the target average ejection amount. In addition, the voltage correction performed by the voltage correction unit 35 is performed when the test chart 21 for correcting the concentration unevenness is recorded or when the image is recorded based on the image data 19.

The concentration correction unit 36 performs the concentration unevenness correction which performs signal conversion processing on the image data 19 read out from the image memory 14 or test chart data 21*a*, based on the concentration unevenness correction LUT 44 read out from the LUT storage unit 34. The image data 19 subjected to the concentration unevenness correction is half-tone processed by the half-tone processing unit, and is output to the head driver 29.

In addition, the generation and the storage (update) of the voltage correction value 41 are performed at arbitrary processing timings such as the time of installation of the ink jet printer 100 or the time of exchange of the head module 9 (first and second head modules 9A and 9B). In addition, the generation and the storage (update) of the concentration unevenness correction LUT 44 is an arbitrary processing start timing such as whenever a predetermined time elapses, whenever a predetermined number of sheets is image-recorded, immediately before the image recording processing (also referred to as print processing) is performed based on the image data 19, or after the update of the above-described voltage correction value 41 is performed.

[Effect of Ink Jet Printer of First Embodiment]

<Voltage Correction Value Generation Processing>

Next, effects of the ink jet printer 100 having the above-described configuration are described. The printer control unit 15 sequentially determines whether or not it becomes the timing of the generation processing of the voltage correction value 41 such as the time of installation of the ink jet printer 100 or the time of exchange of the head module 9 (Step S1). In addition, when it is determined that it becomes the processing start timing of the generation processing of the voltage correction value 41, the printer control unit 15 operates each unit of the ink jet printer 100 and starts the voltage correction value generation processing (YES in Step S1).

The printer control unit 15 controls the transport control unit 28, and controls the head driver 29 such that ink having intermediate-size droplets is hit against the recording medium 102 at the recording concentration of 25% by each nozzle 11 while performing the transport of the recording medium 102 by the recording medium transportation unit 104. Accordingly, since the ink having intermediate-size droplets is hit against the recording medium 102, which is transported by the recording medium transportation unit 104, at the recording density of 25% from each nozzle 11, the test chart 20 is recorded on the recording surface of the recording medium 102 (Step S2).

After the test chart 20 is recorded, the scanner control unit 30 performs tracking on the test chart 20 based on known transport speed information of the recording medium 102. In addition, the scanner control unit 30 performs the concentration measurement by the scanner 128 in accordance with the timing when the test chart 20 passes through the scanner 128 (Step S3). Accordingly, the scanner control unit 30 acquires the concentration measurement results 38 from the scanner 128, and outputs the acquired concentration measurement results 38 to the voltage correction value calculation unit 31.

The voltage correction value calculation unit 31 obtains an average value of the concentration measurement values for each head module 9 which is not subjected to the concentration correction processing or the half-tone processing, based on the concentration measurement results 38 input from the scanner control unit 30. Sequentially, the voltage correction value calculation unit 31 calculates the average ejection amount of ink for each head module 9 as shown in FIG. 6 from the average value of the concentration measurement value for each head module 9, based on the correlation, which is obtained in advance, between the ink ejection amount (droplet amount) and the concentration. In addition, the voltage correction value calculation unit 31 calculates the voltage correction value 41 of the driving signals such that the average ejection amount of ink for each head module 9 is the same as the target average ejection amount. Moreover, the voltage correction value calculation unit 31 stores the voltage correction value 41 for each head module 9 in the correction value storage unit 32 (Step S4).

Hereinafter, when it becomes the processing start timing of the voltage correction value generation processing such as the exchange of the head module 9, the printer control unit 15 controls each unit of the ink jet printer 100 and repeatedly performs the processing of Step S1 to Step S4 (YES in Step S5, and YES in Step S1). Accordingly, the voltage correction value 41 stored in the correction value storage unit 32 is updated.

<Concentration Unevenness Correction LUT Generation Processing>

In addition, the printer control unit 15 sequentially determines whether or not it becomes the processing start timing of the concentration unevenness correction LUT generation processing such as whenever the predetermined time elapses, whenever a predetermined number of sheets is image-recorded, immediately before the image recording processing is performed, or after the update of the voltage correction value 41 is performed. In addition, when it is determined that it becomes the processing start timing, the printer control unit 15 operates each unit of the ink jet printer 100 and starts concentration unevenness correction LUT generation processing (YES in Step S6).

The concentration correction unit 36 acquires the test chart data 21*a* from the image memory 14 under the control of the printer control unit 15. After the test chart data 21*a* is subjected to the concentration correction processing or the half-tone processing by the concentration correction unit 36 and the half-tone processing unit, the test chart data 21*a* is output to the head driver 29. In addition, under the control of the printer control unit 15, ink droplets of each color of CMYK are hit against the recording surface of the recording medium 102 by the ink jet head 106 based on the test chart data 21*a* while the recording medium 102 is transported by the recording medium transportation unit 104. Accordingly, the test chart 21 is recorded on the recording surface of the recording medium 102 (Step S7). In this case, the voltage correction unit 35 corrects the voltages of the driving signals output from the head driver 29 based on the voltage correction value 41 stored in the correction value storage unit 32.

After the test chart 21 is recorded, the scanner control unit 30 performs tracking on the test chart 21 based on the information of the transport speed of the recording medium 102, and performs the concentration measurement by the scanner 128 in accordance with the timing when the test chart 21 passes through the scanner 128 (Step S8). Accordingly, the scanner control unit 30 acquires the concentration measurement results 39 from the scanner 128, and outputs the acquired concentration measurement results 39 to the concentration correction value calculation unit 33.

After the concentration correction value calculation unit 33 obtains the characteristic curve 42 as shown in FIG. 7 based on the concentration measurement results 39 input from the scanner control unit 30, the concentration correction value calculation unit 33 generates the concentration unevenness correction LUT 44 based on the comparison results which are obtained by comparing the characteristic curve Gt of each nozzle 11 and the appropriate characteristic curve Ga. The concentration unevenness correction LUT 44 is determined so as to be a value which can correct variation of the output concentration values between nozzles 11 after the voltage correction is performed. In addition, the concentration correction value calculation unit 33 stores the concentration unevenness correction LUT 44 in the LUT storage unit 34 (Step S9).

Hereinafter, when it becomes the processing start timing of the concentration unevenness correction LUT generation processing such as whenever the predetermined time elapses or after the voltage correction value 41 is updated, the printer control unit 15 controls each unit of the ink jet printer 100 and repeatedly performs the processing of Step S6 to Step S9 (YES in Step S10, and YES in Step S6). Accordingly, the concentration unevenness correction LUT 44 stored in the LUT storage unit 34 is updated.

<Image Recording Processing>

Meanwhile, when an image recording start operation is performed by an operating unit (not shown) or the like, the printer control unit 15 controls each unit of the ink jet printer 100 and starts the image recording processing (YES in Step S10).

When the image recording processing starts, the voltage correction unit 35 acquires the voltage correction value 41 from the correction value storage unit 32, and corrects the voltages of the driving signals, which are output from the head driver 29 to each nozzle 11, for each head module 9 based on the voltage correction value 41 (Steps S11 and S12).

Figure 9:
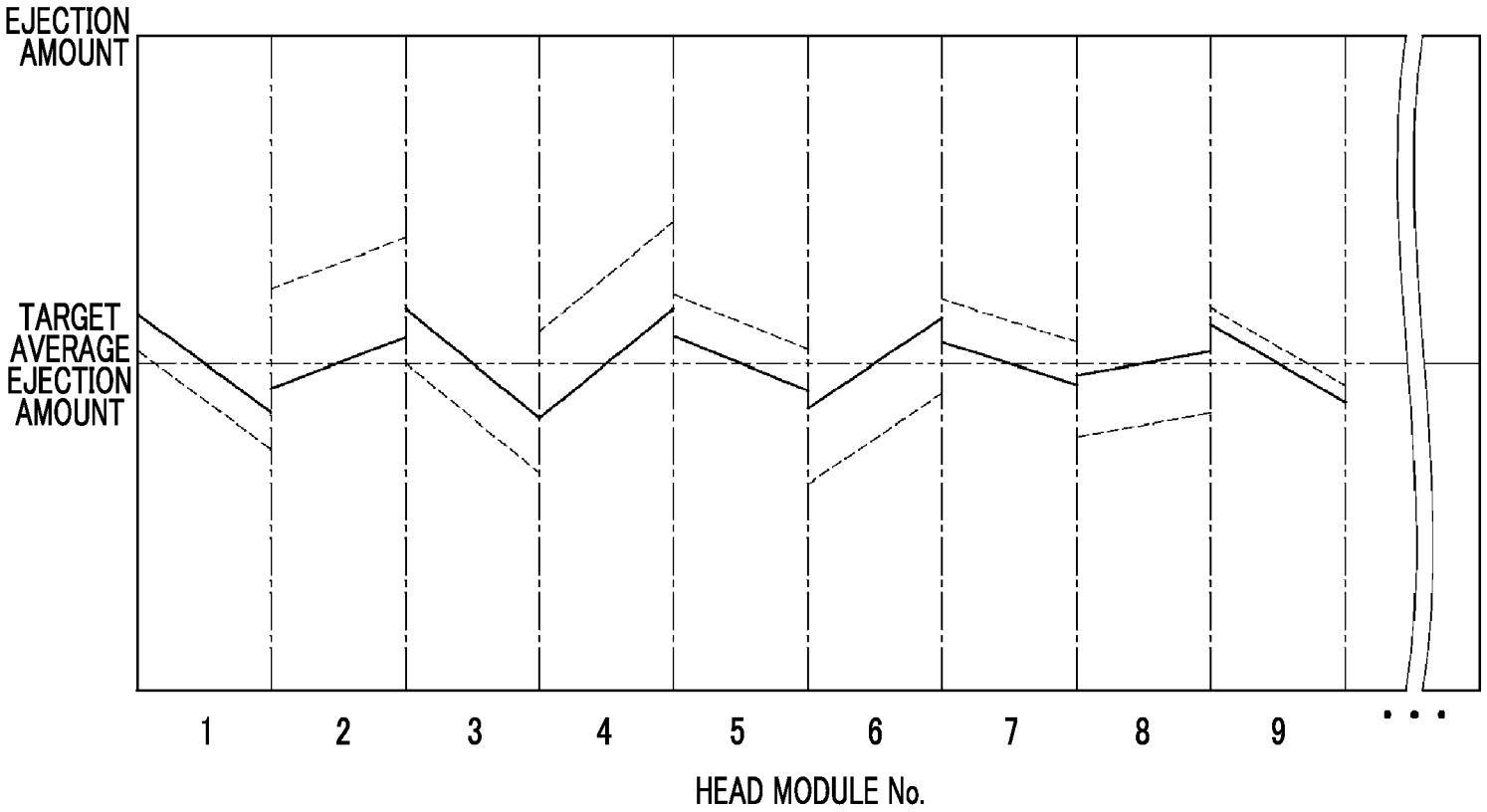
FIG. 9 is an explanatory diagram for explaining the ejection amount distribution of ink of each head module after voltage is corrected.

As shown in FIG. 9, the average ejection amount of ink for each head module 9 is the same as the target average ejection amount by the voltage correction performed by the voltage correction unit 35. Accordingly, compared to a state (indicated by dotted lines in FIG. 9) before the voltage correction is performed, in a state (indicated by solid lines in FIG. 9) after the correction is performed, it is possible to decrease the difference of the ejection amounts at the connection portion between the head modules 9 (first and second head modules 9A and 9B). Hereinafter, the connection portion between the head modules 9 is simply referred to as a "head connection portion".

In addition, as another method for voltage correction, for example, there is a method which performs the voltage correction of driving signals of each head module 9 such that the ejection amount of the head connection portion is continuous. However, in the case of this method, discontinuity of the ejection amount is removed and the concentration unevenness at the head connection portion is suppressed. However, the difference of the ejection amounts of ink of the entire ink jet head 106 increases. As a result, the concentration correction may not be appropriately performed by the concentration correction unit 36, or there is a concern that the ejection amount of ink may exceed an appropriate use range of the head module 9 and ejection stability may be damaged. In addition, in order to perform the voltage correction such that the ejection amount of ink between the head modules 9 has continuity, a lot of time is required for the correction, and it is difficult to adjust the ejection amount.

On the other hand, in the present embodiment, since the voltage correction is performed such that the average ejection amount of ink for each head module 9 is the same as the target average ejection amount, compared to another method, it is possible to prevent the difference of the ejection amounts of ink of the entire ink jet head 106 from increasing. As a result, it is possible to appropriately perform the concentration correction by the concentration correction unit 36, and it is possible to prevent the ejection amount of ink from exceeding the appropriate use range of the head module 9.

Figure 8:
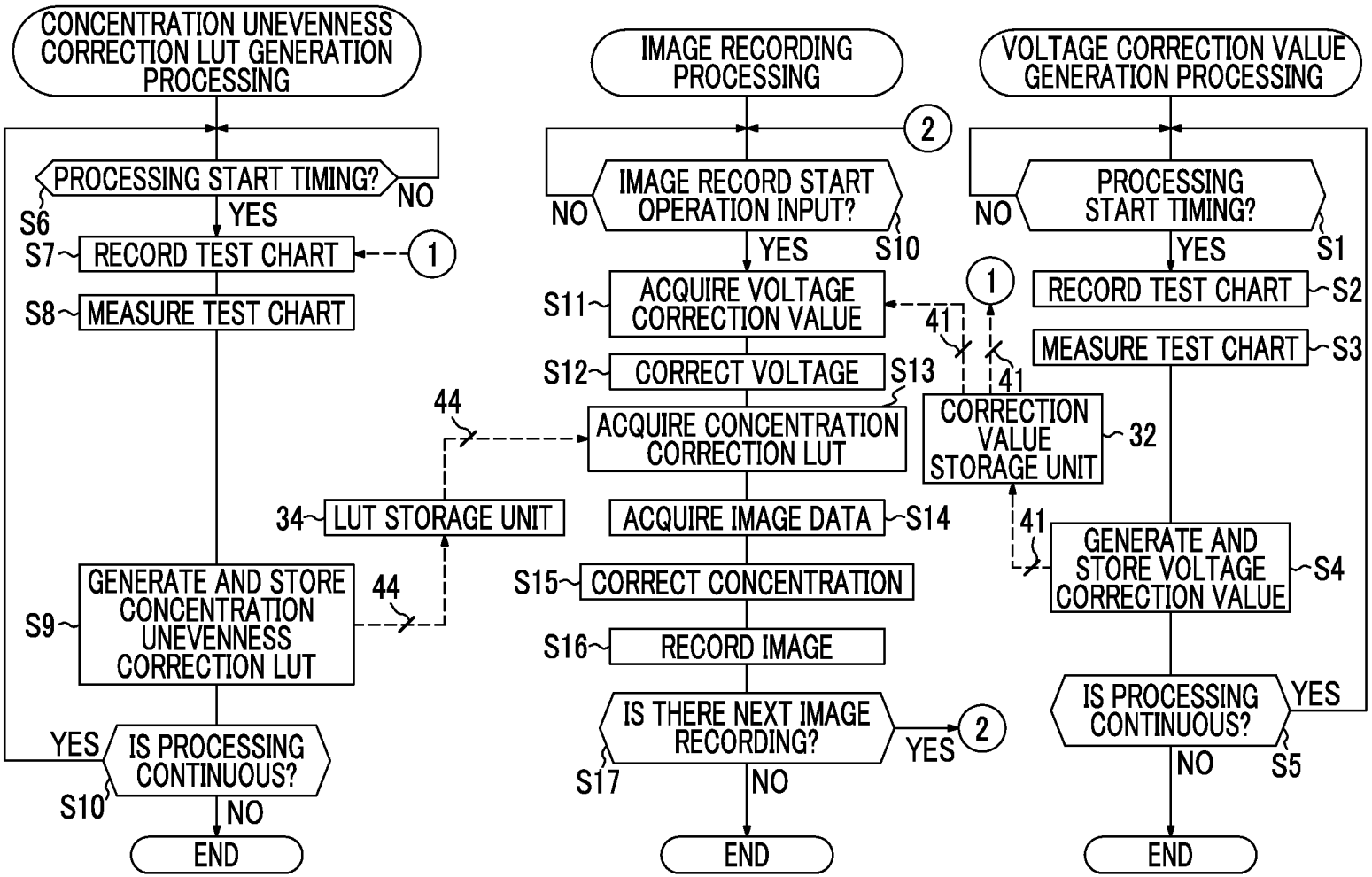
FIG. 8 is an explanatory diagram for explaining voltage correction value generation processing, concentration unevenness correction LUT generation processing, and image recording processing in the ink jet printer.

Returning to FIG. 8, the concentration correction unit 36 acquires the concentration correction from the LUT storage unit 34 (Step S13) and acquires the image data 19 from the image memory 14 (Step S14). Sequentially, the concentration correction unit 36 performs the concentration correction processing on the image data 19 using the concentration unevenness correction LUT 44 (Step S15).

In this case, the ink jet head 106 is configured such that the first and second head modules 9A and 9B having different inclination directions in an ejection amount distribution of ink are alternately connected to each other in the main scanning direction. Accordingly, the difference of the ejection amounts of ink at the head connection portion becomes the difference of the ejection amounts of ink between the end portions in which the ejection amounts of ink of the first and second head modules 9A and 9B are large, or the difference of the ejection amounts of ink between the end portions in which the ejection amounts of ink of the first and second head modules 9A and 9B are small.

Figure 10:
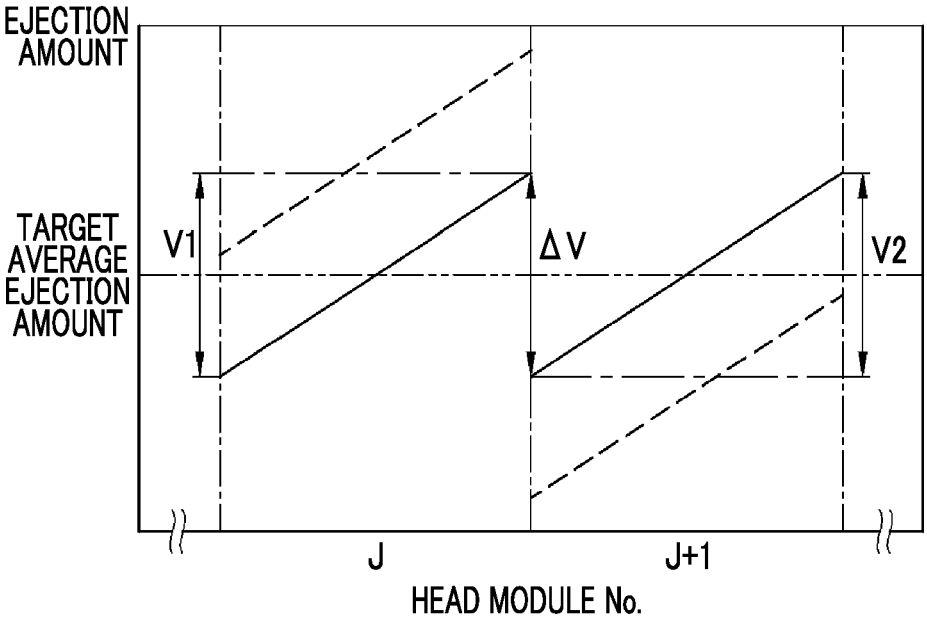
FIG. 10 is an explanatory diagram for explaining a comparative example in which head modules having the same inclination direction in the ejection amount distribution of ink are connected to each other.
Figure 11:
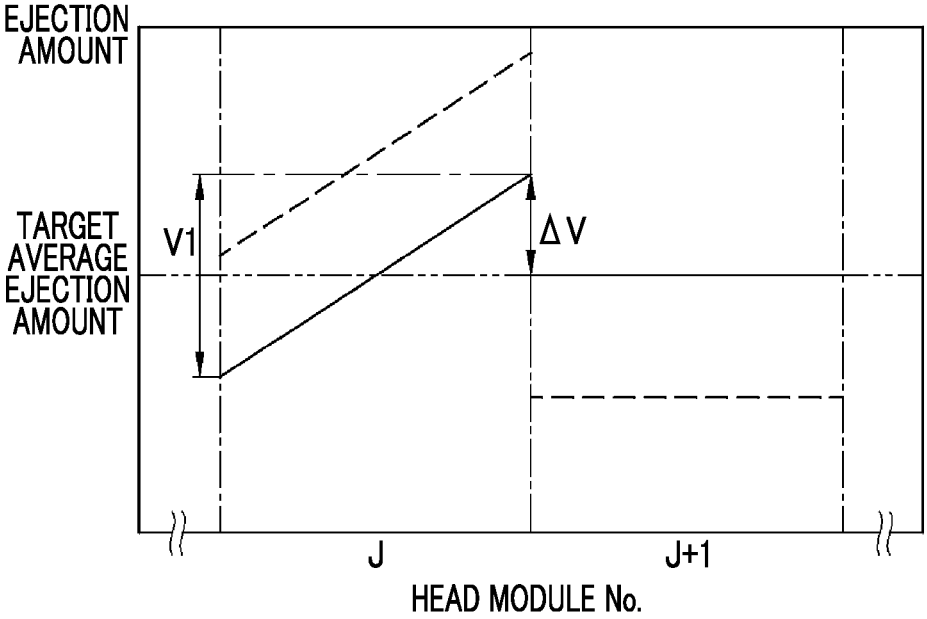
FIG. 11 is an explanatory diagram for explaining a comparative example in which the inclination in the ejection amount distribution of ink of one of the head modules adjacent to each other becomes 0.
Figure 12:
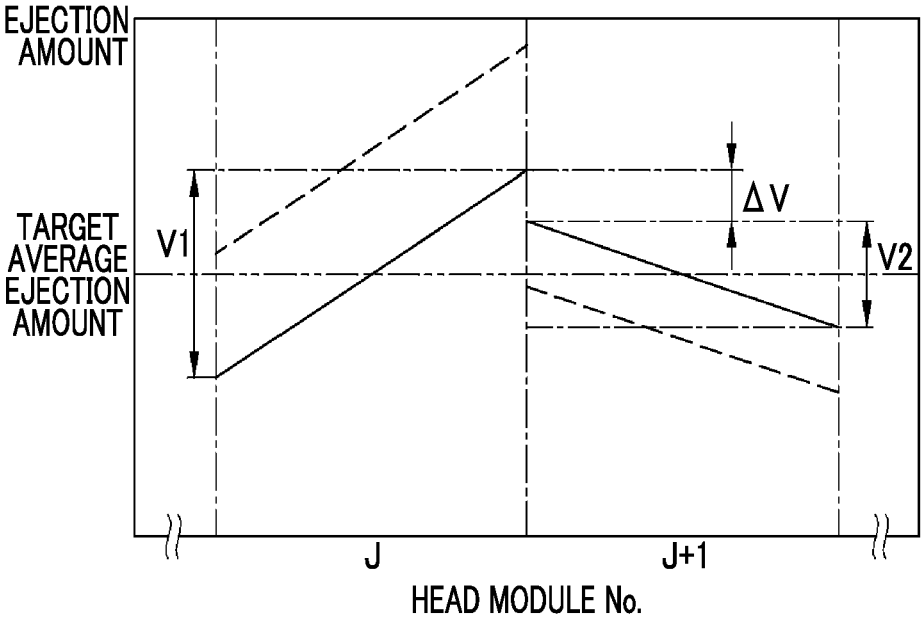
FIG. 12 is an explanatory diagram for explaining the difference of the ejection amounts of ink at a connection portion of the head module of the present invention.

When the differences of the ejection amounts on both end portions of each of the first and second head modules 9A and 9B are defined as V1 and V2, a difference ΔV of the ejection amounts at the connection portion between the head modules 9 is expressed by $\Delta V=(\frac{1}{2}\times V1)+(\frac{1}{2}\times V2)$ (refer to FIGS. 10 to 12). In addition, this expression is an expression in the case where the ejection amount distribution of ink of each head module 9 is expressed by a linear function. Moreover, like the first head module 9A and the second head module 9B, when the end portions having large ejection amounts of ink are different from each other, one of V1 and V2 in the expression has a negative value.

As shown in FIG. 10 showing a comparative example, in a case where rows of the head modules 9 are not completely regulated, when the maximum value of the differences ΔV of the ejection amounts of ink on both end portions of each of the head modules 9 adjacent to each other is defined as Vmax (V1=Vmax, and V2=Vmax), the maximum value of the difference of the ejection amounts at the head connection portion satisfies ΔV=Vmax.

Meanwhile, as shown in FIG. 11, when the difference of the ejection amounts of ink on both end portions of one of the head modules 9 adjacent to each other is Vmax (V1=Vmax) and the difference of the ejection amounts of ink on both end portions of the other is 0, the maximum value of the difference ΔV of the ejection amounts of ink at the head connection portion satisfies $\Delta V=(\frac{1}{2})\times Vmax$.

In addition, as the present invention shown in FIG. 12, when the first and second head modules 9A and 9B having different inclination directions in the ejection amount distribution of ink are alternately connected in the main scanning direction, the maximum value of the difference ΔV of the ejection amounts of ink at the head connection portion is smaller than $\Delta V=(\frac{1}{2})\times Vmax$ shown in FIG. 11. Accordingly, since it is possible to decrease the difference ΔV of the ejection amounts of ink at the head connection portion, it is possible to suppress the occurrence of the concentration unevenness at the head connection portion.

Returning to FIG. 8, after the half-tone processing is performed on the image signals of the image data 19 subjected to the concentration correction processing, the image signals are output to the head driver 29. The head driver 29 outputs the driving signals subjected to the voltage correction to each nozzle 11 of the ink jet head 106 based on the image signals of four values subjected to the half-tone processing. Under the control of the printer control unit 15, ink of each color of CMYK is hit against the recording surface of the recording medium 102 by the ink jet head 106 while the recording medium 102 is transported by the recording medium transportation unit 104. Accordingly, images based on the image data 19 are recorded on the recording surface of the recording medium 102 (Step S16).

Hereinafter, the processing of Step S10 to Step S16 is repeatedly performed until the image recording is ended by the ink jet printer 100 (YES in Step S17, and YES in Step S10).

In addition, when the voltage correction value 41 or the concentration unevenness correction LUT 44 is not updated, the processing of Step S11 or Step S13 may be omitted.

<Exchange of Head Module>

Figure 13:
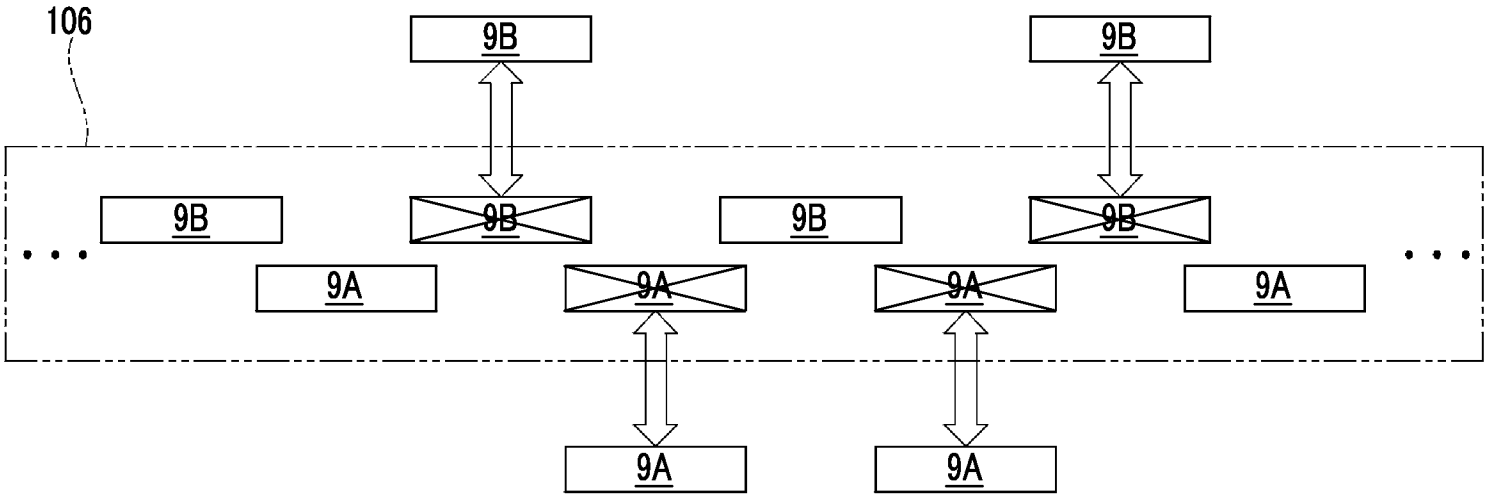
FIG. 13 is an explanatory diagram for explaining exchange of the head module in the ink jet head of the first embodiment.

As shown in FIG. 13, the first head module 9A mounted on the ink jet head 106 can be exchanged with a first head module 9A of the same kind, and the second head module 9B can be exchanged with a second head module 9B of the same kind. Accordingly, when the first head module 9A fails (for example, failures such as a case where ink is not ejected from the nozzle 11 occur at a predetermined frequency or more), the failed first head module 9A is exchanged with a first head module 9A for exchange. Inversely, when the second head module 9B fails, the failed second head module 9B is exchanged with a second head module 9B for exchange. Accordingly, since the first and second head modules 9A and 9B are alternately connected to each other in the main scanning direction after the head module is exchanged, it is possible to suppress the occurrence of the concentration unevenness at the head connection portion.

In addition, when the head module 9 is exchanged, the voltage correction value generation processing is performed, the voltage correction value 41 is updated, and thereafter, the concentration unevenness correction LUT generation processing is performed, and the concentration unevenness correction LUT 44 is updated.

<Effects of the Present Invention>

As described above, in the present invention, since the ink jet head 106 is configured such that the first and second head modules 9A and 9B are alternately connected in the main scanning direction, it is possible to decrease the difference ΔV of the ejection amounts of ink at the head connection portion. Accordingly, it is possible to suppress the occurrence of the concentration unevenness at the head connection portion. In addition, in the related art, since the concentration unevenness occurs in the head module 9 having the difference of the ejection amounts of ink on both end portions, the head module 9 cannot be used. However, in the present invention, the head module 9 can be used. Accordingly, it is possible to increase yields of the head module 9.

[Configuration of Ink Jet Printer (Ink Jet Head) of Second Embodiment]

Next, an ink jet printer of a second embodiment of the present invention is described. In the ink jet head 106 of the ink jet printer 100 of the above-described first embodiment, the first and second head modules 9A and 9B having different inclination directions in the ejection amount distribution of ink are configured so as to be alternately connected to each other in the main scanning direction. Meanwhile, in an ink jet head 130 (refer to FIG. 15) of an ink jet printer of a second embodiment, the head modules 9 having the same inclination direction in the ejection amount distribution of ink can be connected to each other.

Except that the ink jet printer of the second embodiment has the ink jet head 130 different from the ink jet head 106 of the first embodiment, the configuration of the ink jet printer of the second embodiment is substantially the same as the configuration of the ink jet printer 100 of the first embodiment. Accordingly, the same reference numerals are assigned to portions having the same functions and the same configurations as the first embodiment, and descriptions thereof are omitted.

Figure 14:
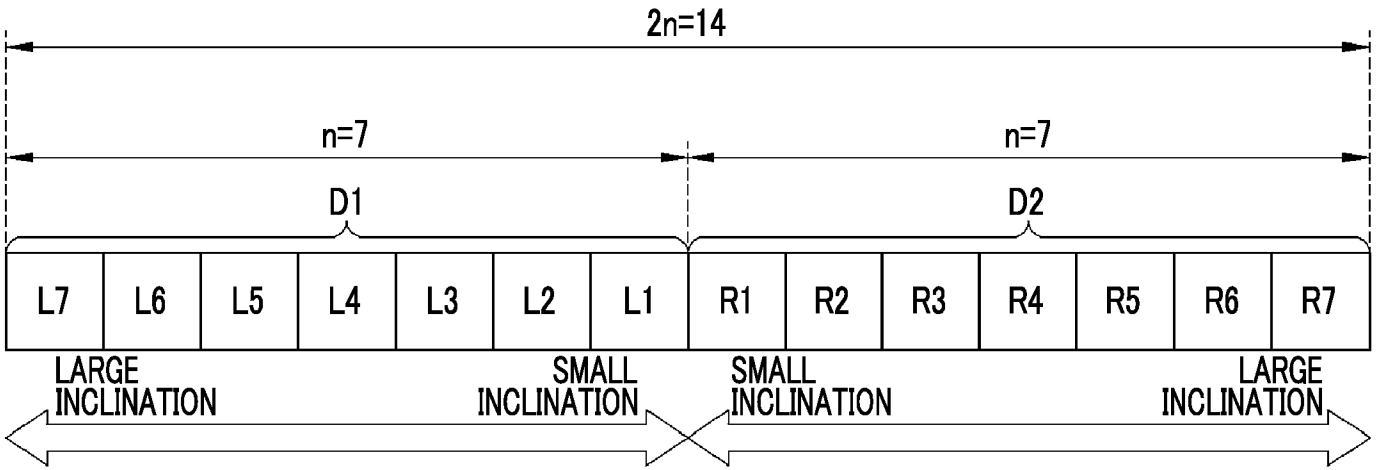
FIG. 14 is an explanatory diagram for explaining a division of 2n steps of the head modules in a second embodiment.

As shown in FIG. 14, the head modules 9 mounted on the ink jet head 130 are divided into 2n (n is a natural number of 2 or more) steps, in the present embodiment, 14 steps with n=7, for example, according to the differences of the ejection amounts of ink on one end portion and the other end portion. In addition, a division method of each step is described below.

The divisions of 14 steps are configured of a first division D1 in which the first head modules 9A are divided into 7 steps (n=7), and a second division D2 in which the second head modules 9B are divided into 7 steps (n=7). Here, each step of the first division D1 is expressed by Li step (ith step), and each step of the second division D2 is expressed by Ri step (ith step). In addition, i satisfies $1 \leq i \leq n$ (here, n=7), the Li step becomes L1, L2, . . . , L7 as the difference of the ejection amounts (inclination in the ejection amount distribution) of ink increases, and the Ri step also becomes R1, R2, . . . , R7 as the difference of the ejection amounts of ink increases.

In the ink jet head 130, the relationship between the head modules 9 adjacent to each other is determined according to each step (L1 to L7 and R1 to R7) of the difference of the ejection amounts of ink. Specifically, the head modules 9 adjacent to each other are configured of head modules 9 in which the difference of the ejection amounts of ink with respect to the head module 9 of the ith step in one of the first division D1 and the second division D2 and the head module 9 of the ith step of the other is within k (k is a natural number of (n−1) or less) steps. Hereinafter, as the head modules 9 adjacent to each other, a head module having a head module No. J and a head module having a head module No. J+1 (J is an arbitrary natural number) are described as examples.

Figure 15:
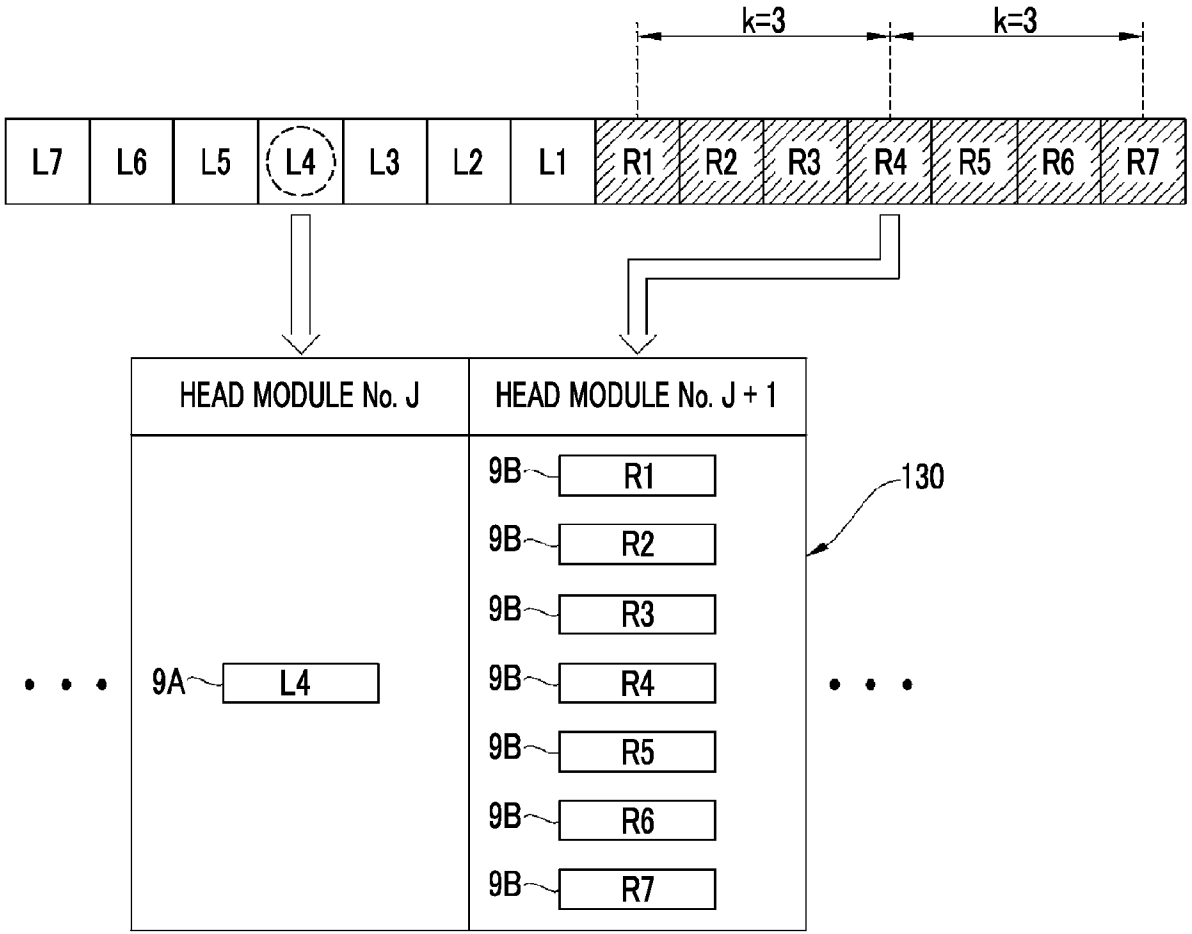
FIG. 15 is an explanatory diagram for explaining a head module which can be disposed so as to be adjacent to a head module of L4 step in the ink jet head of the second embodiment.

As shown in FIG. 15, any one of the second modules 9B of (2k+1) kinds of R(i−k) step to R(i+k) step is selected and disposed in the vicinity of the first head module 9A of the Li step. For example, when n=7 and k=3 are satisfied, the second head modules 9B of the R1 step to the R7 step, in which the difference of the ejection amounts of ink with respect to the second head module 9B of the R4 step is within 3 steps, are disposed in the vicinity of the first head modules 9A (indicated by a dotted-line circle) of the L4 step.

In addition, any one of the first head modules 9A of (2k+1) kinds of the L(i−k) step to the L(i+k) step is selected and disposed in the vicinity of the second head modules 9B of the Ri step. For example, when n=7 and k=3 are satisfied, the first head module 9A of any one of the L1 step to the L7 step is disposed in the vicinity of the second head module 9B of the R4 step.

Figure 16:
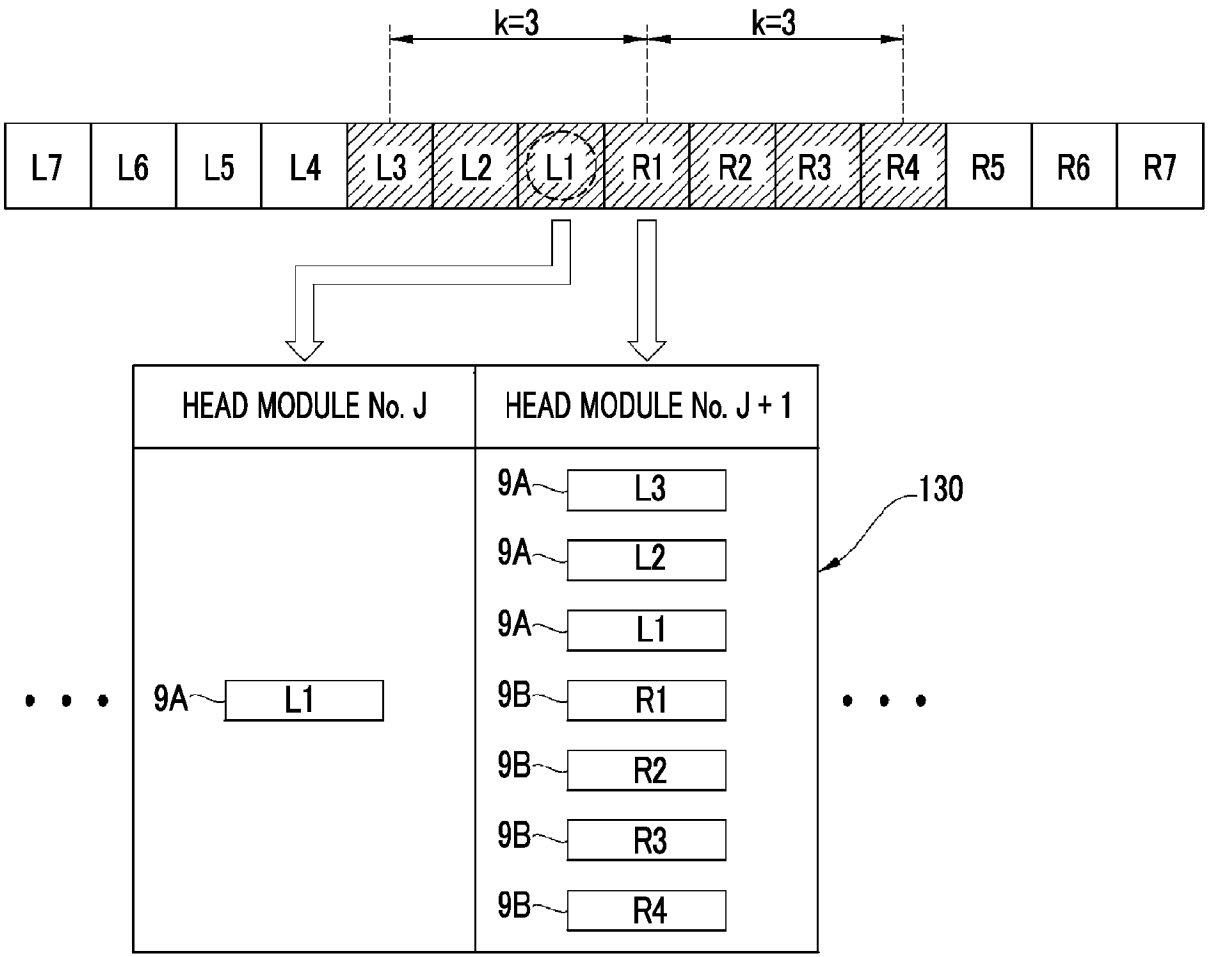
FIG. 16 is an explanatory diagram for explaining a head module which can be disposed so as to be adjacent to a head module of L1 step in the ink jet head of the second embodiment.

Here, as shown in FIG. 16, the difference of the ejection amounts of ink between the L1 step and the R1 step is regarded as one step. Accordingly, for example, any one of the first and second head modules 9A and 9B of an Lk step to an R(k+1) step is selected and disposed in the vicinity of the first head module 9A of the L1 step. Accordingly, for example, when n=7 and k=3 are satisfied, any one of the first and second head modules 9A and 9B of the L3 step to the R4 step is disposed in the vicinity of the first head module 9A of the L1 step.

In addition, for example, any one of the first and second head modules 9A and 9B of an L(k+1) step to an Rk step is selected and disposed in the vicinity of the second head module 9B of the R1 step. Accordingly, for example, when n=7 and k=3 are satisfied, any one of the first and second head modules 9A and 9B of the L4 step to the R3 step is disposed.

Figure 17:
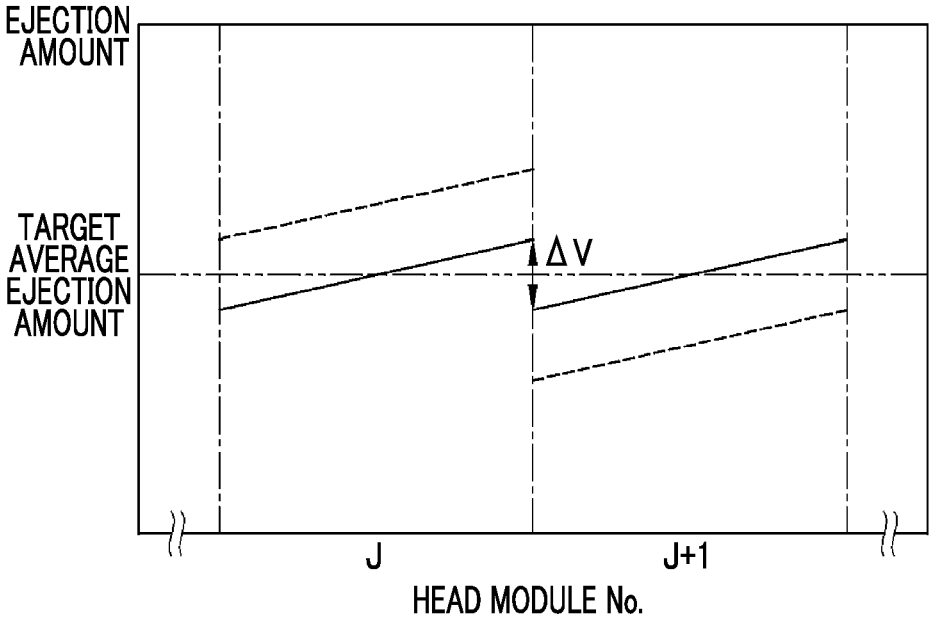
FIG. 17 is an explanatory diagram for explaining a case where head modules having the same inclination direction in the ejection amount distribution of ink are connected to each other in the ink jet head of the second embodiment.

In this case, as shown in FIG. 17, for example, two first head modules 9A of the L1 step can be disposed so as to be adjacent to each other, or two second head modules 9B of the R1 step can be disposed so as to be adjacent to each other. That is, it is possible to connect the first head modules 9A or the second head modules 9B, which have the same inclination direction in the ejection amount distribution of ink, to each other. Moreover, similarly to the first embodiment, dotted lines in FIG. 17 show the state before the voltage correction is performed, and solid lines show the state after the voltage correction is performed.

Figure 18:
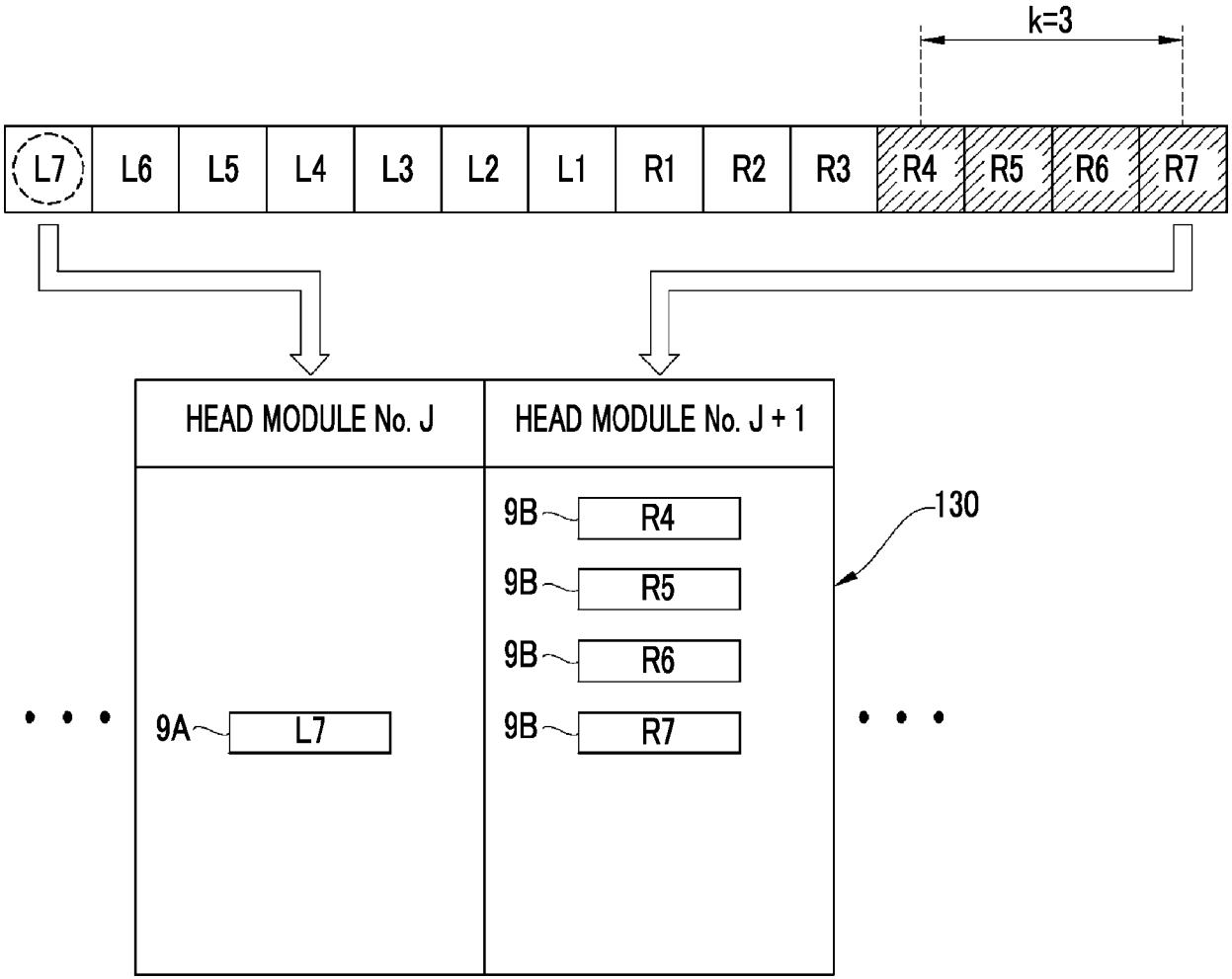
FIG. 18 is an explanatory diagram for explaining a head module which can be disposed so as to be adjacent to a head module of L7 step in the ink jet head of the second embodiment.

As shown in FIG. 18, for example, any one of the second head modules 9B of an R(n−k) step to an Rn step is selected and disposed in the vicinity of the first head module 9A of the Ln step. Accordingly, when n=7 and k=3 are satisfied, any one of the second head modules 9B of the R4 step to the R7 step is disposed in the vicinity of the first head module 9A of the L7 step.

Moreover, for example, any one of the first head modules 9A of the Ln step to L(n−k) step is selected and disposed in the vicinity of the second head module 9B of the Rn step. Accordingly, when n=7 and k=3 are satisfied, any one of the first head modules 9A of the L7 step to the L4 step is disposed in the vicinity of the second head module 9B of the R7 step.

Figure 19:
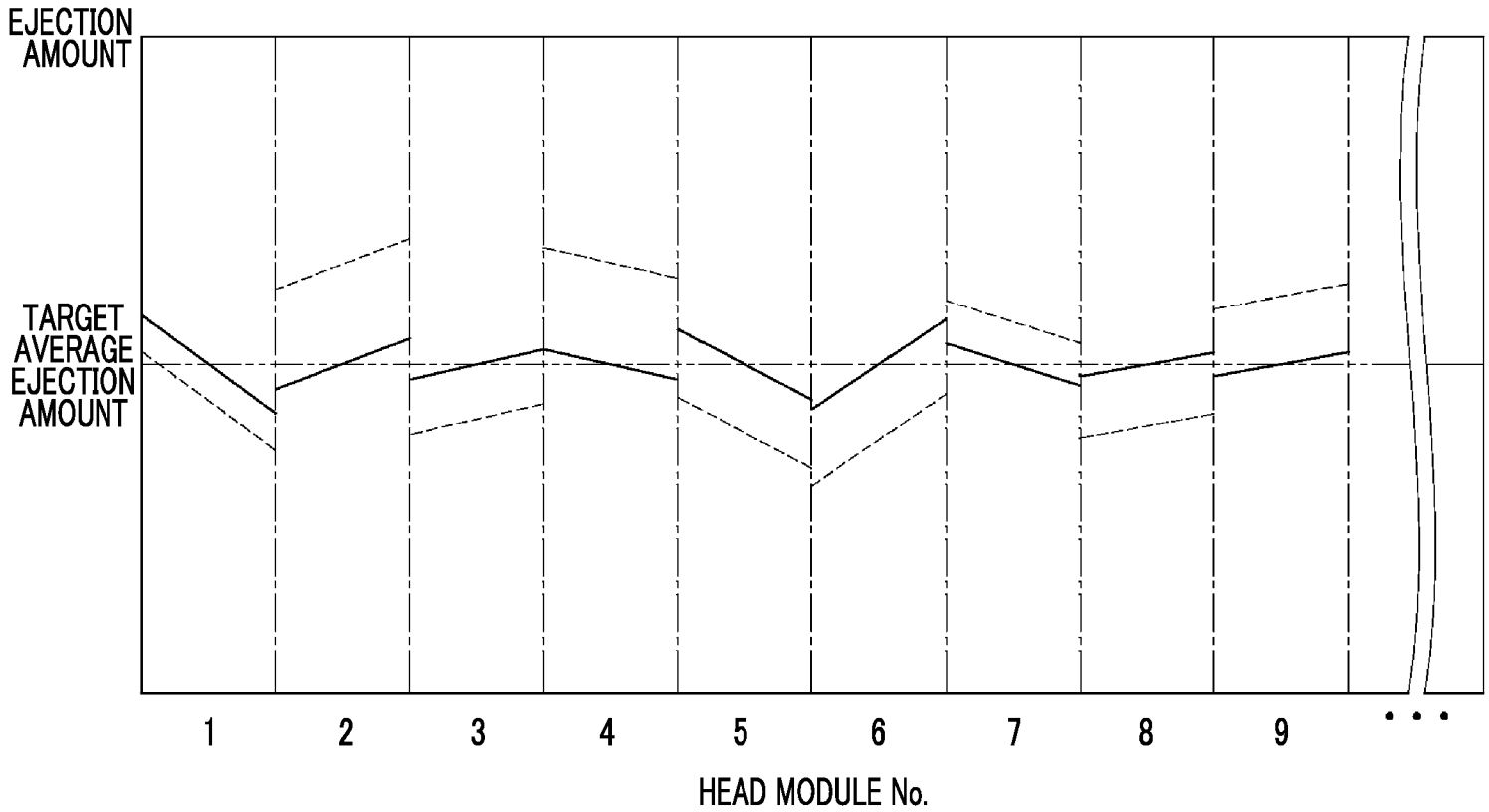
FIG. 19 is an explanatory diagram for explaining the ejection amount distribution of ink of each head module after voltage is corrected.

As shown in FIG. 19, the ink jet head 130 is configured such that the head modules 9, in which the above-described relationships shown in FIG. 15, FIG. 16, FIG. 18, or the like are satisfied, are connected to each other. Moreover, similarly to the first embodiment, since the average ejection amount of ink for each head module 9 is the same as the target average ejection amount by the voltage correction performed by the voltage correction unit 35, it is possible to decrease the difference of the ejection amounts of ink at the head connection portion.

<Setting Method (1) of 2n Step (n Step of First and Second Head Modules)>

As a setting method of the 2n steps (14 steps) in which the head modules 9 are divided, that is, as a setting method of the n steps in which the first and second head modules 9A and 9B are respectively divided, there is a method in which ranges of steps are uniformly divided. Specifically, each step is set such that ranges in the difference of the ejection amounts of ink on both end portions of the head module 9 corresponding to the ranges of each of the steps are uniform.

If the ranges of the steps are uniform, it is possible to allow the maximum value of the difference ΔV of the ejection amounts at the head connection portion to be (k/2n)×Vmax or less. Accordingly, it is possible to further decrease the difference of the ejection amounts of ink at the head connection portion than that of the first embodiment in which the first and second head modules 9A and 9B are alternately connected in the main scanning direction. Therefore, as shown in FIG. 17, even when the first head modules 9A or the second head modules 9B having the same inclination direction in the ejection amount distribution of ink are connected to each other, it is possible to decrease the difference ΔV of the ejection amounts of ink at the head connection.

<Setting Method (2) of 2n Step (n Step of First and Second Head Modules)>

In addition, as methods different from the method of uniformly dividing the ranges of the steps, in consideration of manufacturing variation of the head module 9, there is a method of setting each step such that the number of the head modules 9 divided into each step is uniform. In the above-described method of uniformly dividing the ranges of the steps, for example, when the first head module 9A of the Ln step is used, two second head modules 9B (one second head module may be provided when it is disposed on the end of the ink jet head 106) of the R(n−k) step to the Rn step are required. In this case, in reality, in order to dispose the second head modules so as to be arranged in the vicinity of the first head module 9A of the Ln step, not only the ejection amount of ink but also the distribution of defective nozzles is required to be considered. Accordingly, until the second head module 9B which can be disposed so as to be arranged in the vicinity of the first head module 9A of the Ln step is secured, the first head module 9A of the Ln step remains as a stock module.

Meanwhile, when each step is set such that the number of the head modules 9 divided into each step is uniform, the head modules 9 divided into each step are manufactured at the same ratio. Accordingly, when the head modules 9, in which the above-described relationships shown in FIG. 15, FIG. 16, and FIG. 18 are satisfied, are connected to each other, it is possible to decrease stock of the head module 9.

As a specific example of the case where the number of the head modules 9 divided into each step is uniform, for example, a case is described in which the head module 9, in which the difference of the ejection amounts of ink on both end portions of the head module 9 is ±3σ (99.7%) according to a normal distribution, is used as the ink jet head 130. When the difference of the ejection amounts is made in accordance with the normal distribution, since the head modules 9 divided into each step are manufactured at the same probability by obtaining the value of each Z according to a reference normal distribution table using a variable Z=(x−μ)/σ which is obtained by normalizing a probability variable x, it is possible to divide the head modules into the same number in each step. In this case, the maximum value of the difference ΔV of the ejection amounts at the head connection portion can be (x/2n)×Vmax using x obtained by the following Expression (1).

$$\frac{1}{n} = \int_{x}^{3o} \frac{1}{\sqrt{2\pi\sigma^2}} \exp\left(-\frac{(x-\mu)^2}{2\sigma^2}\right) \tag{1}$$

In this way, when the setting of each step is performed considering the manufacturing variation of the head module 9, it is possible to further decrease the difference of the ejection amounts of ink at the head connection portion than that of the first embodiment. Accordingly, similarly to the above-described case in which the ranges of the steps are uniformly divided, in the case where the first head modules 9A and the second head modules 9B having the same inclination direction in the ejection amount distribution of ink are connected to each other, it is possible to decrease the difference ΔV of the ejection amounts of ink at the head connection portion. In addition, in actual manufacturing of the head modules 9, deviations or the like occur and the head modules may not follow the normal distribution. However, in this case, the ranges of the steps may be modified such that the head modules 9 divided into each step have the same number.

<Effects of Ink Jet Printer of Second Embodiment>

As described above, in the ink jet printer of the second embodiment, since the head modules 9 are divided into each step according to the difference of the ejection amounts of ink on both end portions and are connected to each other so as to satisfy the above-described predetermined relationship, it is possible to decrease the difference ΔV of the ejection amounts of ink at the head connection portion. Accordingly, similarly to the first embodiment, it is possible to suppress the occurrence of the concentration unevenness at the head connection portion.

<Modification Example of Ink Jet Printer of Second Embodiment>

Figure 20:
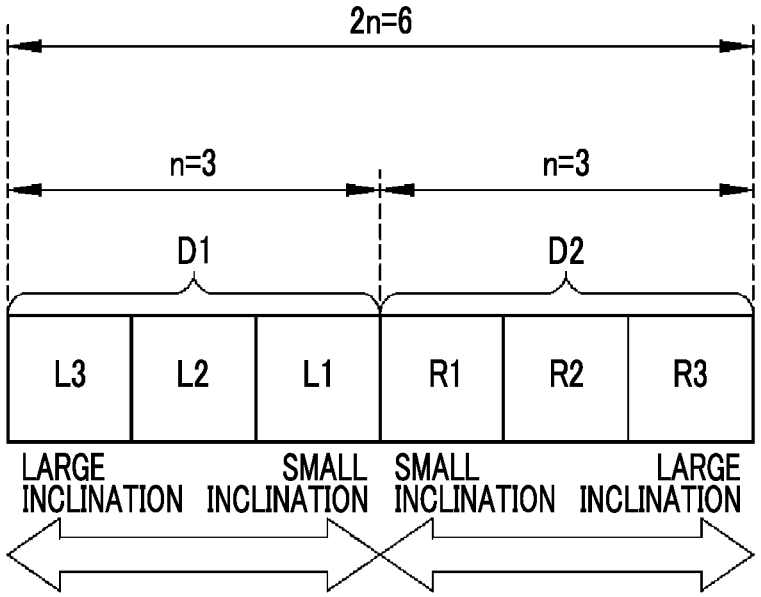
FIG. 20 is an explanatory diagram for explaining a modification example of the second embodiment in which n=3 is satisfied.

In the second embodiment, the head modules 9 mounted on the ink jet head 130 are divided into 14 steps (n=7) according to the difference of the ejection amount of ink. However, as shown in FIG. 20, the head modules 9 may be divided into 6 steps (n=3). That is, the first and second head modules 9A and 9B are respectively divided into 3 steps. Moreover, in this case, "k" indicating the number of the steps of the difference of the ejection amounts between the head modules 9 satisfies k=1. In addition, similarly to the first embodiment, the first head modules 9A and the second head modules 9B are disposed so as to be alternately arranged in the main scanning direction (refer to FIG. 22).

As shown in FIG. 21, when n=3 and k=1 are satisfied, it is possible to dispose all the second head modules 9B of the R1 step to the R3 step in the vicinity of the first head module 9A of the L2 step (second step). Conversely, it is possible to dispose the first head module 9A of the L2 step in the vicinity of all the second head modules 9B of the R1 step to the R3 step.

In addition, it is possible to dispose all the first head modules 9A of the L1 step to the L3 step in the vicinity of the second head module 9B of the R2 step (second step). Conversely, it is possible to dispose the second head module 9B of the R2 step in the vicinity of all the first head modules 9A of the L1 step to the L3 step.

Figure 22:
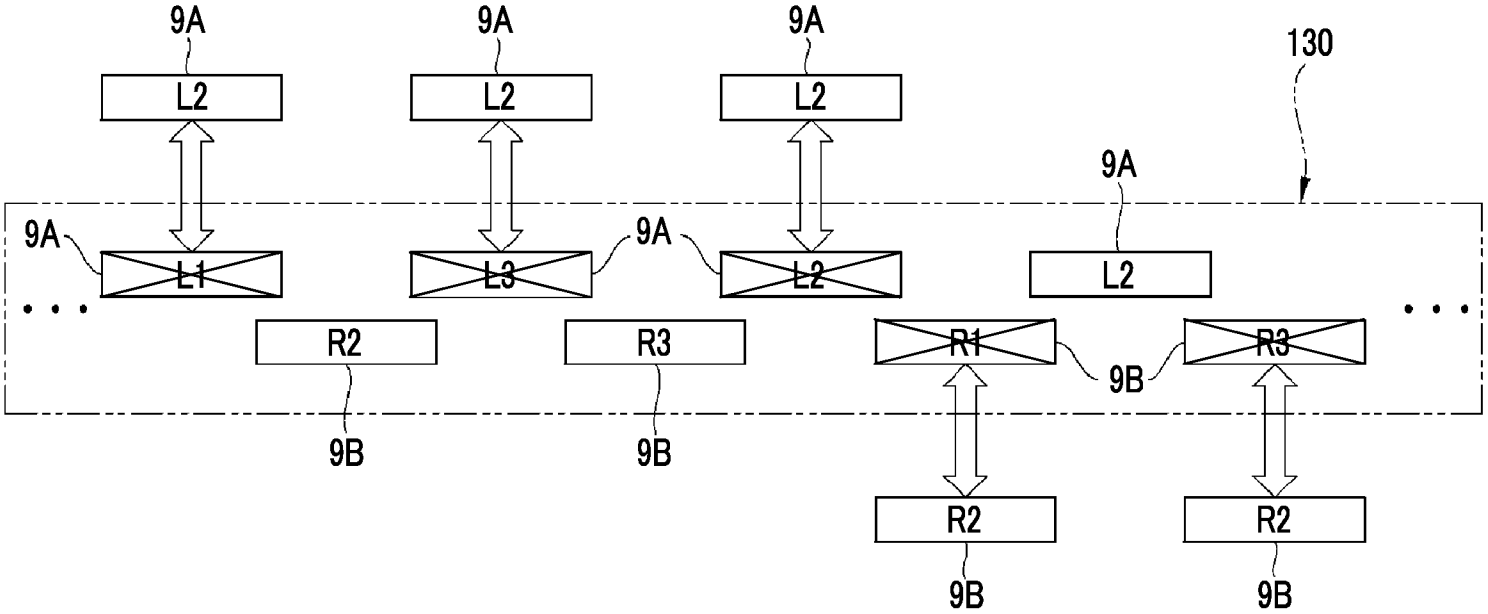
FIG. 22 is an explanatory diagram for explaining exchange of the head module in a modification example of the second embodiment.

In this way, it is possible to dispose the first head module 9A of the L2 step in the vicinity of the second head modules 9B of the three steps, and conversely, it is possible to dispose the second head module 9B of the R2 step in the vicinity of the first head modules 9A of the three steps. Accordingly, as shown in FIG. 22, when the first and second head modules 9A and 9B are disposed so as to be alternately arranged in the main scanning direction, the head modules 9 for exchange can be set to only the first head module 9A of the L2 step (second step) and the second head module 9B of the R2 step (second step). Accordingly, it is possible to decrease the kinds of stock of the head modules 9 for exchange. In addition, since the present modification example is substantially the same as the second embodiment except that the values of n and k are different, the present modification example has the same effects as the above-described effects of the second embodiment.

[Others]

In each embodiment, in the ink heads 106 and 130, the head modules 9 (first head module 9A and second head module 9B) are disposed in a zigzag in the main scanning direction. However, the disposition (connection method) of the head modules 9 may be appropriately modified.

In the second embodiment, the method of uniformly dividing the ranges of n steps into which the first and second head modules 9A and 9B are divided, and the method of uniformly dividing the number of the first and second head modules 9A and 9B divided into each step are described. However, the method may be appropriately selected. For example, in consideration of the state of the concentration unevenness, the yields of the head modules 9, the number of stock of the head modules 9, or the like, any one of both methods or a combination of both methods may be appropriately selected.

In the ink jet heads of the above-described embodiments, four colors of CMYK are recorded. However, the number and the kind of the recorded colors are not particularly limited, and may be appropriately selected.

In the above-described embodiments, the belt transport type ink jet printer 100 in which the recording medium 102 is transported by the transportation belt 108 is exemplified. However, the transport method of the recording medium 102 is not particularly limited. For example, other transport methods such as an impression-cylinder transport method may be appropriately selected. In addition, instead of the recording medium moving with respect to the fixed ink jet head, for example, the present invention may also be applied to an ink jet printer including a shuttle head type ink jet header in which the recording head moves with respect to the recording medium.

In the embodiments, the application of the ink jet printer for printing graphics is described as an example. However, the application range of the present invention is not limited to this. For example, the present invention may be widely applied to various recording devices which draw various shapes or patterns using functional liquid materials such as a wiring drawing device which draws wiring patterns of an electronic circuit, a manufacturing device of various devices, a resist printing device which uses a resin liquid as a functional liquid for ejection, a manufacturing device of a color filter, or a microstructure forming device which forms microstructures using a material for material deposition.

EXPLANATION OF REFERENCES

9: head module
9A: first head module
9B: second head module
31: voltage correction value calculation unit
33: concentration correction value calculation unit
35: voltage correction unit
36: concentration correction unit
100: ink jet printer
106 (106K, 106C, 106M, 106Y): ink jet head

What is claimed is:

1. A recording head comprising a plurality of head modules in which a plurality of nozzles for ejecting liquid droplets are arranged and which are connected in one direction, wherein the plurality of head modules include a first head module in which an ejection amount of the liquid droplets of one end portion in the one direction of the head module is larger than an ejection amount of the liquid droplets of the other end portion opposite to the one end portion, and a second head module in which the ejection amount of the liquid droplets of one end portion is larger than the ejection amount of the liquid droplets of the other end portion, and the plurality of head modules are configured so as to be alternately connected such that the one end portion of the first head module and the one end portion of the second head module are connected and the other end portion of the second head module and the other end portion of the first head module are connected in the one direction.

2. A recording head comprising a plurality of head modules in which a plurality of nozzles for ejecting liquid droplets are arranged and which are connected in one direction, wherein when n is a natural number of 2 or more, i is a natural number such that $1 \leq i \leq n$, and k is a natural number of $(n-1)$ or less, the plurality of head modules are divided into two divisions including:

a first division comprising a first plurality of head modules for which an ejection amount of liquid droplets of the one end portion is larger than an ejection amount of liquid droplets of the other end portion, and a second division comprising a second plurality of head modules for which the ejection amount of liquid droplets of the other end portion is larger than the ejection amount of liquid droplets of the one end portion, and each division is further divided into n steps according to a difference of ejection amounts of liquid droplets in one end portion in the one direction and the other end portion opposite to the one end portion, for a total of 2n steps corresponding to the plurality of head modules, and i serves as an increment counter of the steps; wherein the recording head is configured with head modules selected from the 2n steps such that a head module of i-th step in one of the first division and the second division is adjacent to a head module within k steps of the i-th step of the other division.

3. The recording head according to claim 2, wherein each step corresponds to a range in the difference of the ejection amounts between the one end portion and the other end portion of the head modules, and the steps are uniformly divided.

4. The recording head according to claim 3, wherein n is 3 and k is 1.

5. The recording head according to claim 4, wherein the head modules of the first division and the head modules of the second division are alternately connected in the one direction, and the head module of the first division which is divided into a second step among 3 steps is used for the head module for exchange of the head module of the first division, and the head module of the second division which is divided into a second step among 3 steps is used for the head module for exchange of the head module of the second division.

6. The recording head according to claim 2, wherein the number of the head modules belonging to each of the steps is uniform.

7. The recording head according to claim 6, wherein n is 3 and k is 1.

8. The recording head according to claim 7, wherein the head modules of the first division and the head modules of the second division are alternately connected in the one direction, and the head module of the first division which is divided into a second step among 3 steps is used for the head module for exchange of the head module of the first division, and the head module of the second division which is divided into a second step among 3 steps is used for the head module for exchange of the head module of the second division.

9. The recording head according to claim 2, wherein n is 3 and k is 1.

10. The recording head according to claim 9, wherein the head modules of the first division and the head modules of the second division are alternately connected in the one direction, and the head module of the first division which is divided into a second step among 3 steps is used for the head module for exchange of the head module of the first division, and the head module of the second division which is divided into a second step among 3 steps is used for the head module for exchange of the head module of the second division.

* * * * *